US005466293A

United States Patent [19]

Tanaka et al.

[11] Patent Number: 5,466,293

[45] Date of Patent: Nov. 14, 1995

[54] COATING APPARATUS FOR PROVIDING A SUPERFICIAL PROTECTIVE LAYER ON A CARD

[75] Inventors: Takeshi Tanaka; Daiki Minamino; Akira Yoshizaki; Nakaya Nakano, all of Hino, Japan

[73] Assignee: Konica Corporation, Tokyo, Japan

[21] Appl. No.: 169,588

[22] Filed: Dec. 17, 1993

[30] Foreign Application Priority Data

| | | | |
|---|---|---|---|
| Jan. 14, 1993 | [JP] | Japan | 5-000710 U |
| Jan. 21, 1993 | [JP] | Japan | 5-008570 |
| Jan. 25, 1993 | [JP] | Japan | 5-010093 |
| Jan. 26, 1993 | [JP] | Japan | 5-10900 |

[51] Int. Cl.[6] ..... B05C 1/00

[52] U.S. Cl. ..... 118/264; 118/58; 118/266; 118/267; 118/642; 118/684; 118/694

[58] Field of Search ..... 118/684, 676, 118/677, 694, 642, 58, 239, 264, 266, 267, 268; 427/429

[56] References Cited

U.S. PATENT DOCUMENTS

| | | | |
|---|---|---|---|
| 3,603,286 | 9/1971 | Scopp et al. | 118/64 |
| 3,786,736 | 1/1974 | Neib et al. | 118/266 |
| 4,408,562 | 10/1983 | DeCamp et al. | 118/677 |
| 4,489,671 | 12/1984 | Choinski | 118/266 |
| 4,924,800 | 5/1990 | Tanaka | 118/642 |
| 4,962,721 | 10/1990 | Peek | 118/264 |
| 4,995,934 | 2/1991 | Janatka | 118/264 |
| 5,012,758 | 5/1991 | Künzler | 118/264 |
| 5,054,417 | 10/1991 | Bhatia et al. | 118/264 |
| 5,242,497 | 9/1993 | Miller et al. | 118/232 |

FOREIGN PATENT DOCUMENTS

| | | | |
|---|---|---|---|
| 3519539 | 12/1986 | Germany | 118/264 |
| 90261 | 6/1989 | Japan . | |
| 90266 | 6/1989 | Japan . | |
| 0209608 | 8/1989 | Japan | 427/429 |

*Primary Examiner*—W. Gary Jones
*Assistant Examiner*—Laura E. Edwards
*Attorney, Agent, or Firm*—Frishauf, Holtz, Goodman, Langer & Chick

[57] ABSTRACT

An apparatus for forming a protective layer on a card by use of a resin solution, includes a coating head having a fiber member, wherein the coating head is relatively positioned on the card so as to be brought in contact with a portion of a surface of the card so that the resin solution is transferred onto the contact portion of the card through the fiber member. The apparatus includes a moving device to selectively move at least one of the coating head and the card so as to move the contact portion along the surface of the card so that the surface of the card is coated with the resin solution.

26 Claims, 22 Drawing Sheets

COATING APPARATUS FOR PROVIDING A SUPERFICIAL PROTECTIVE LAYER ON A CARD

BACKGROUND OF THE INVENTION

The present invention relates to a coating apparatus for providing a uniform superficial protective layer on the surface of a small-sized card such as a license or an ID card.

In recent years, cards-have progressed remarkably and utilization thereof has expanded sharply. In particular, various types of cards relating to identification such as an ID card or a license are also increasing steadily.

These cards naturally need to be protected from forgery and from scratches caused by handling. For these cards, a specific photographic paper is frequently used, and a laminating method has been popular for them. In the course of laminating, however, bubbles tend to enter, and time-consuming punching is required after laminating, which cause cost increase. In contrast to this, among those methods for coating resins directly, there are some methods which are excellent in terms of cost. For example, Japanese Patent Application Nos. 90261/1989 and 90266/1989 disclose a method wherein a coating roll is used.

However, the aforementioned method is a bead coating therefore, beads of a coating solution are hung from the trailing edge of a card, causing the so-called thicker layer on the trailing edge which makes a protective layer to be uneven. In addition to the foregoing, many portions on an apparatus are exposed to coating solutions, which makes handling difficult.

Due to the nature of a card, there is a demand for a card having a superficial protective layer excellent in resistance to scratches, waterproofing, resistance to chemicals and in surface smoothness.

SUMMARY OF THE INVENTION

The first object of the invention is to provide a coating apparatus for coating a superficial protective layer which makes a card to have properties of resistance to scratches, waterproofing and resistance to chemicals through a coating method wherein the aforementioned problems have been solved, a protective layer can be formed uniformly and handling is easy.

The first object mentioned above can be attained by either one of the following technologies.

A coating apparatus for a superficial protective layer on a card wherein a coating unit having felt, nonwoven substance, or porous fibrous substance such as cotton as a coating member and a moving means that moves the surface to be coated of a card-shaped object to be coated relatively to the coating unit are used for coating in an apparatus for coating the coating solutions on the surface of a card-shaped object to be coated to form a protective layer.

A coating apparatus for a superficial protective layer on a card wherein a coating unit having velvet, velvet called suede or fibrous fabric such as woven cloth as a coating member and a moving means that moves the card-shaped object to be coated relatively to the coating unit in the direction of the surface of the card-shaped object to be coated are used for coating in an apparatus for coating the coating solutions on the surface of a card-shaped object to be coated to form a protective layer.

Next, preferable embodiments of the aforementioned coating apparatuses will be explained. The aforementioned coating solution is oozed out to a coating member through an internal member to be coated.

Narrow grooves are provided on both sides of an opening for supplying solution to the internal member so that coating solutions may be supplied on a uniform distribution basis.

When the coating unit mentioned above comes in contact with a card-shaped object to be coated, a coating solution is oozed out to the coating unit on an on-demand basis to be coated.

There is provided an elevating means which lifts or lowers a card-shaped object to be coated against the aforesaid coating unit so that the card-shaped object to be coated may touch or leave the coating unit.

There is provided at the downstream side of the coating unit a processing unit wherein the coating solution coated on the aforementioned card-shaped object to be coated is subjected to energy rays processing The processing unit mentioned above is positioned to be in a light-shielding position against the coating unit by being tilted.

The processing unit mentioned above is positioned to be in a light-shielding position, by providing a step on the card conveying surface.

The second object of the invention is to provide a coating member which causes no irregular coating mottle and to provide construction of a coating unit which does not stain surroundings.

The second object can be attained by either of the following technologies.

A coating method for a superficial protective layer on a card wherein in a coating apparatus for forming a hard coat as a superficial protective layer on a card through coating by oozing out UV resins from a coating member composed of a fibrous fabric to be coated on a card-shaped object to be coated such as a license or an ID card, the coating member is represented by velvet.

A coating apparatus for a superficial protective layer on a card wherein in a coating apparatus in which UV resins are oozed out from a coating member composed of a fibrous fabric to be coated on a card-shaped object to be coated such as a license or an ID card, a hard coat is formed as the superficial protective layer on a card, wherein the coating member is made of velvet, and the coating member is mounted on a coating head in a manner in which the coating member is placed along the internal surface of a jig having its internal shape whose dimension is larger than an external surface of the coating head by at least a thickness of the coating member, the holder is covered by the jig by lifting a clip or the coating head and after holding the coating member with the clip, the jig is removed and the coating member is mounted on the coating head after being stretched by a spring action of the clip on the holder.

A coating apparatus for a superficial protective layer on a card wherein in a coating apparatus in which UV resins are oozed out from a coating member composed of a fibrous fabric to be coated on a card-shaped object to be coated such as a license or an ID card, a hard coat is formed as the superficial protective layer on a card, wherein the coating member is made of velvet, and a coating member is mounted on the holder in a manner that the coating member in a long belt roll shape is fed out from a feeding section to be wound round the coating head along the external shape on at least a coating position on the coating head, and when the coating member has been deteriorated, a fresh coating member in a fixed amount is fed out from the feeding section by a feed roller to be mounted on the coating head to replace the deteriorated coating member which is simultaneously taken up on a take-up section.

A coating apparatus for a superficial protective layer on a card wherein in a coating apparatus in which UV resins are oozed out from a coating member composed of a fibrous fabric to be coated on a card-shaped object to be coated such as a license or an ID card, a hard coat is formed as the superficial protective layer on a card, wherein the coating member is an endless-belt-shaped velvet, and the coating member is mounted on the coating head so that the coating member may be wound round the coating head while being guided by the external shape of the coating head and by a guide roller, and when the coating member of the coating unit has been deteriorated, an endless-belt-shaped coating member in a fixed amount is moved in one direction so that a fresh coating member may be mounted at the coating position on the coating head replacing the deteriorated coating member.

The third object of the invention is to provide a coating apparatus for a superficial protective layer on a card which can be operated easily and cleaned easily and is stable, by developing a simple coating solution supply unit that keeps a level of a coating solution in a coating solution tank constant.

The third object of the invention can be attained by a coating apparatus for a superficial protective layer on a card wherein in a coating apparatus in which UV resins are oozed out from a coating member composed of a fibrous fabric to be coated on a card-shaped object to be coated such as a license or an ID card, a coating solution container, having an opening therein, is loaded with an end of its opening facing downward at a predetermined position on a coating solution vat provided in the coating apparatus so that the opening may be opened concurrently with the loading of the coating solution container to cause coating solutions in the coating solution container to be supplied into the coating solution vat until a level of a coating solution in the vat reaches the position of the end of the opening, and after that, coating solutions in the coating solution container corresponding in quantity to those consumed are supplied automatically, such that, a level of a coating solution in the coating solution vat is kept at the end surface of the opening.

The fourth object of the invention is to provide a coating method for a superficial protective layer on a card wherein coating with an established thickness can be conducted stably even when there occur changes with time in supply pressure of a coating solution and in coating solution viscosity caused by variation of a level of a coating solution in a coating solution tank and temperature.

The fourth object of the invention can be attained by either of the following technological means.

A coating method for a superficial protective layer on a card wherein in a coating apparatus for forming a hard coat as a superficial protective layer on a card through coating by oozing out epoxy type UV-setting resins from a coating member composed of a fibrous substance or a fibrous fabric to be coated on a card-shaped object to be coated such as a license or an ID card, an amount of a coating solution supplied from a coating solution tank to a coating unit is controlled by opening and closing a solenoid valve.

As a preferred embodiment of the aforementioned coating method, the releasing time for the solenoid valve is changed according to a level of a coating solution in a coating solution tank.

By changing timing for releasing a solenoid valve, a coating weight is changed within the same card.

Viscosity of a coating solution can be kept constant by keeping the temperature of a coating solution to a predetermined level totally or locally The fifth object of the invention is to provide a forming apparatus for s superficial protective layer wherein when coating a resin solution on a card-shaped object to be coated, the card-shaped object to be coated and an apparatus are hardly stained and excellent products are obtained.

The fifth object of the invention mentioned above can be attained by a forming apparatus for a superficial protective layer comprising a belt for conveying a card-shaped object to be coated, a coating means for coating on the surface of the card-shaped object to be coated a coating, a moving means for moving a part of the belt mentioned above to the side of the coating means, and a control means for controlling an action of the moving means, wherein the card-shaped object to be coated conveyed by the belt is brought into contact with the coating means by the moving means then coating is coated on the surface of the card-shaped object to be coated conveyed, and after completion of coating, the moving means is returned to its original position.

The fifth object of the invention mentioned above can also be attained by a forming apparatus for a superficial protective layer comprising a conveyance means for conveying a card-shaped object to be coated, a coating means for coating on the surface of the card-shaped object to be coated a coating, a moving means for moving the coating means to the side of the conveyance means, and a control means for controlling an action of the moving means, wherein the coating means is brought into contact with the card-shaped object to be coated conveyed by the conveyance means by the moving means then coating is coated on the surface of the card-shaped object to be coated conveyed, and after completion of coating, the coating means is returned to its original position.

Namely, a forming apparatus for a superficial protective layer of the invention is structured so that a card-shaped object to be coated and a coating means can come in contact with each other or leave each other. Therefore, coating has no opportunity to stick except a period of coating operation, thus, an apparatus is hardly stained.

Especially when a conveyance means is provided with a belt and when there is provided a lifting means for lifting a part of the belt to the side of the coating means, the card-shaped object to be coated is conveyed along the belt almost angled by the lifting means. Therefore, at the moment when the card-shaped object to be coated comes in contact with a coating unit, the leading edge of the card-shaped object to be coated arrives at the peak (upward slope) on the belt, and accordingly, the leading edge of the card-shaped object to be coated leaves the belt immediately after the coating has been coated. For that reason, the coating does not stick to the belt, and a phenomenon called a spreading-to-back that the coating sticks to the back side on the tip of the card-shaped object to be coated does not happen, and excellent products can be obtained.

Even when a lowering means that lowers a coating means to the side of a conveyance means is provided, the coating does not stick to a belt, and excellent products are obtained.

Incidentally, it is preferable that a coating head where a coating means comes in contact with a card-shaped object to be coated is made of a flexible material (preferably, a fibrous fabric) and it can be transformed. In a forming apparatus for a superficial protective layer equipped with a coating head composed of a flexible material as that mentioned above, it is preferable that the coating head comes in contact with a card-shaped object to be coated, and the coating head is structured so that an amount of transformation of the coating head may reduce monotonically as the coating head moves relatively while it is in contact with the card-shaped object to be coated. Further, it is preferable that the coating head comes in contact with the card-shaped object to be coated, and the coating head is structured so that an amount of transformation of the coating head may reduce stepwise as the coating head moves relatively while it is in contact with the card-shaped object to be coated. It is further preferable that the coating head is structured so that an amount of transformation of the coating head is maintained constant in the initial stage of the contact between the coating head and the card-shaped object to be coated, and then it is reduced thereafter.

BRIEF DESCRIPTION OF THE DRAWINGS

FIG. 7 (B) is a plan view of the same.

FIG. 8 (B) is a plan view of the diffusion plate.

Each of FIGS. 24–28 represents a sectional view showing an apparatus for carrying out a UV resin coating process.

Figure 29:
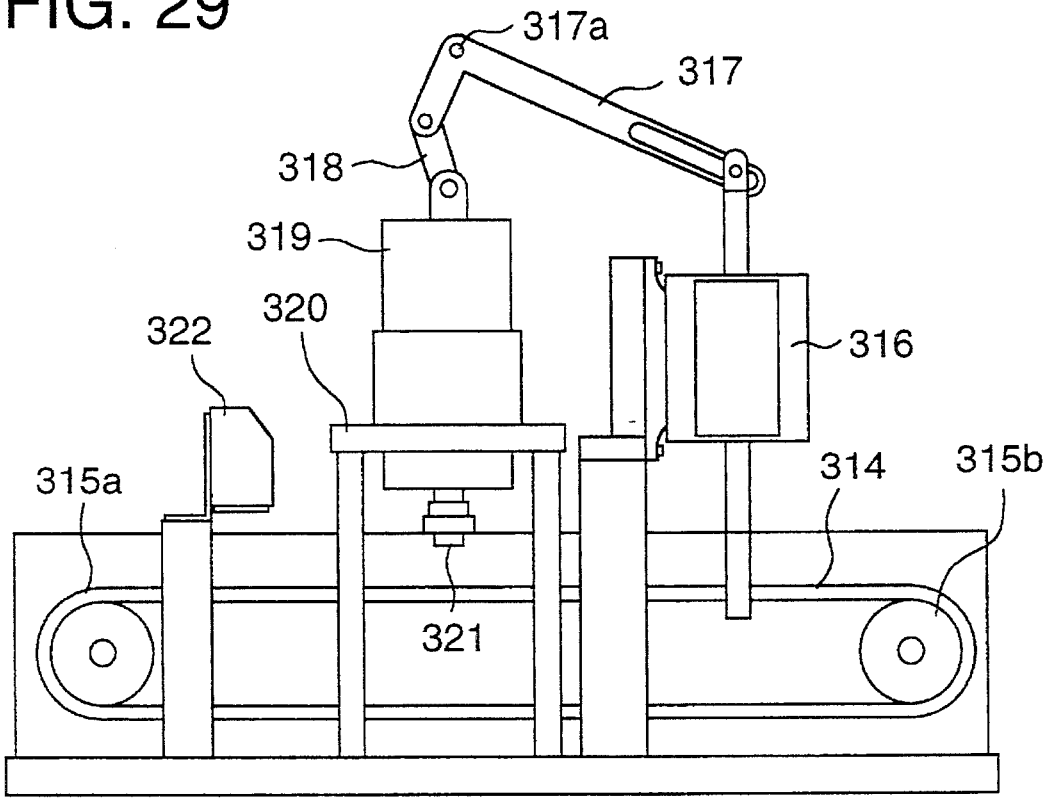

FIG. 29 is a schematic sectional view of a forming apparatus for a superficial protective layer related to the second example of the invention attaining the fifth object of the invention.

Each of FIGS. 30–36 represents how a card comes in contact with a coating head.

DETAILED DESCRIPTION OF THE PREFERRED EMBODIMENT

An outline of the total constitution of an example of the coating apparatus of the invention will be explained as follows, referring to a front view in FIG. 1.

Card-shaped objects to be coated 11 are supplied from card supplier 10 and are set one sheet by one sheet on pallet or stage 26 affixed on belt or chain 25 of conveying unit 20 comprising the endless belt or chain 25 engaged with driving wheel 21 and with driven wheel 22, and each of them is conveyed to a coating position. A method for affixing the card-shaped object to be coated 11 on the stage 26 includes various means such as suction, friction, adhesion, static electricity and a claw-shaped protrusion. In the coating position, there is a standby coating means 100 comprising coating solution tank 101 and coating unit 110 having thereon coating member 107.

The aforementioned pallet or stage 26 approaching the coating position is held in a slidable manner on guide rail 27 whose both sides are fixed. Therefore, the pallet or stage 26 can be kept accurately in terms of its height direction and its crosswise direction. In the coating position, coating unit 110 of the coating means 100 is slightly pressed down, and thereby the coating member 107 located at the bottom of the coating unit 110 is brought into contact with the card-shaped object to be coated 11 on the pallet or stage 26 under the pressure that is uniform in the crosswise direction. Owing to the contact between them, coating solution 102 supplied from the coating solution tank 101 in necessary quantity and is oozed out on the coating member 107 is transferred to be coated uniformly onto the card-shaped object to be coated 11 on the moving pallet or stage 26. When the trailing edge of the card-shaped object to be coated 11 arrives at the coating position, communication between the coating unit 110 and the coating solution tank 101 is cut, and coating is ended.

The coating unit 110 falls on the leading edge of the card-shaped object to be coated 11 to come in contact with the card-shaped object to be coated 11 when the card-shaped object to be coated 11 comes under the coating unit 110, and the coating unit 110 rises from the trailing edge of the card-shaped object to be coated to leave the card-shaped object to be coated 11 when coating ends. Owing to this, it is possible to prevent that a coating solution sticks to the pallet or stage 26 such as a pallet or a stage conveying card-shaped object to be coated 11 and a coating solution spreads even to the reverse side of the card-shaped object to be coated.

In addition to a function to lift and lower the coating unit 110, a mechanism for a vertical motion that brings the coating unit 110 into contact with card-shaped object to be coated 11 or separates them may lift or lower, together with the card, the pallet or stage 26 of a conveyer that conveys the card-shaped object to be coated.

Further, the card-shaped object to be coated 11 does not necessarily need to be on pallet or stage 26 but it may be on the conveyer directly when the card-shaped object to be coated 11 is conveyed. In this case, the mechanism for a vertical motion that brings coating unit 110 into contact with card-shaped object to be coated 11 lifts the belt surface of a conveyer belt or lowers it for the vertical motion. Even when the card-shaped object to be coated 11 is conveyed while it is brought into contact with a conveyer, a mechanism for vertical motion for bringing the coating unit 110 into contact with card-shaped object to be coated 11 or separating them may lift and lower the coating unit 110.

When lifting and lowering the coating unit 110, it is also possible to separate the coating unit 110 from coating solution tank 101 and lift and lower only the coating unit 110. In this case, it is preferable that the coating unit 110 is connected to the coating solution tank 101 by means of a solution-conveying tube, and the coating unit 110 and the coating solution tank 101 can respectively be replaced simply in a cartridge-replacement manner. Further, when a valve is provided between the coating solution tank 101 and the coating unit 110, it is possible to make parts for cartridge-replacement small by employing a method wherein the solution-conveying tube is squeezed for interruption of a coating solution and released from squeezing for opening thereof.

It is preferable that the coating solution tank 101 is open to the atmosphere because it sometimes happen that internal pressure in the coating solution tank 101 is changed by fluctuation of ambient temperature or the like when the coating solution tank 101 is sealed hermetically, causing inconstant amount of supplied solution that makes stable coating impossible.

The card-shaped object to be coated 11 which has been finished in terms of coating is conveyed to processing unit 30 where the card-shaped object to be coated 11 is subjected to irradiation of energy rays such as ultraviolet rays or the like and coated solution is set by the energy rays for finishing. The card-shaped object to be coated 11 is collected after it has passed the processing unit 30.

Figure 1:
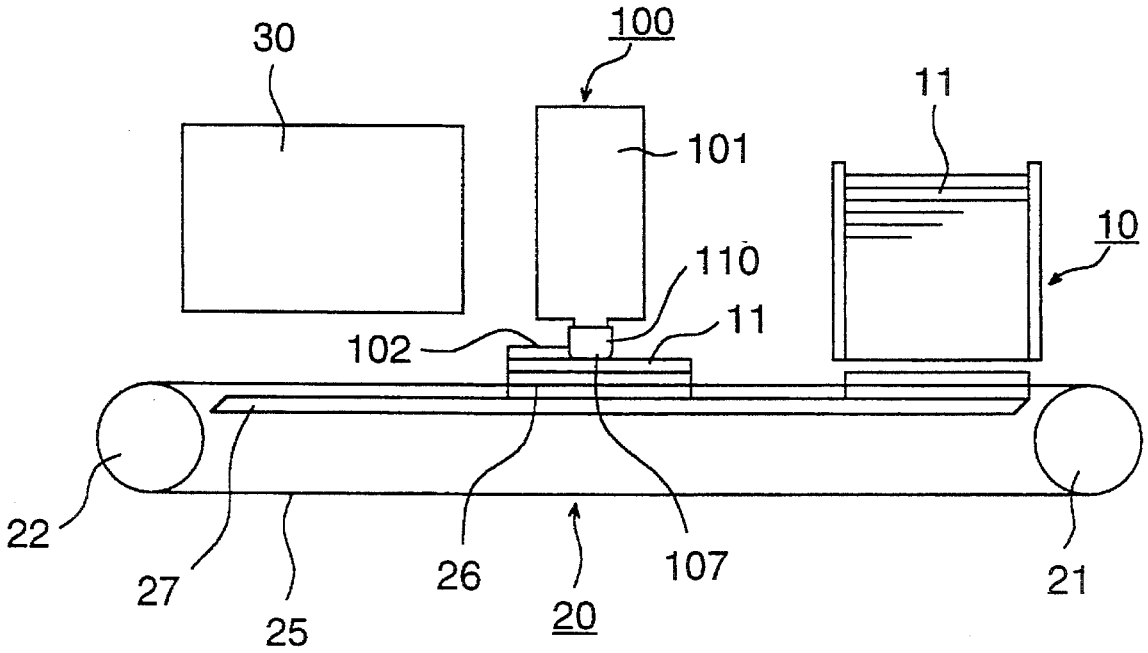
FIG. 1 is a front view showing an outline of the total constitution of an example of the invention.
Figure 2:
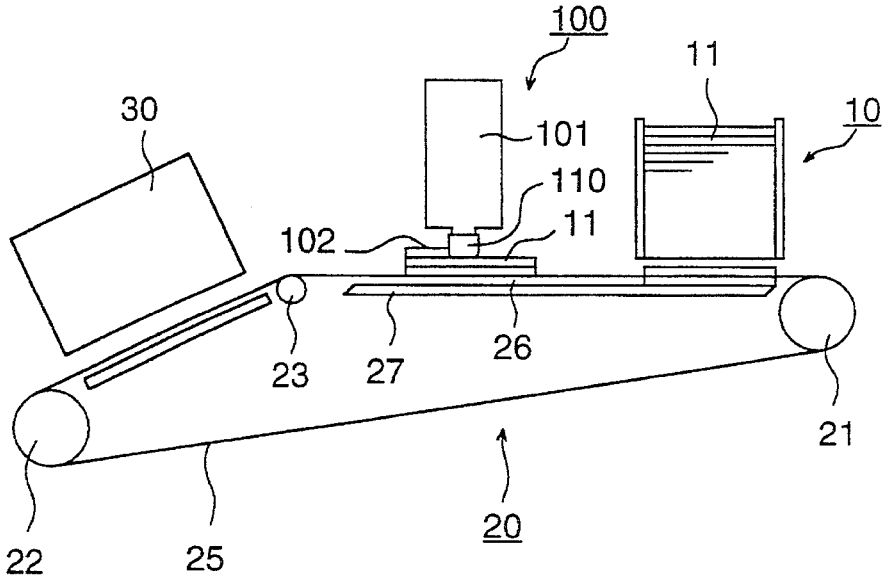
FIGS. 2(A) and 2(B) are front views respectively showing an outline of the total constitution of two examples of the invention.
Figure 2:
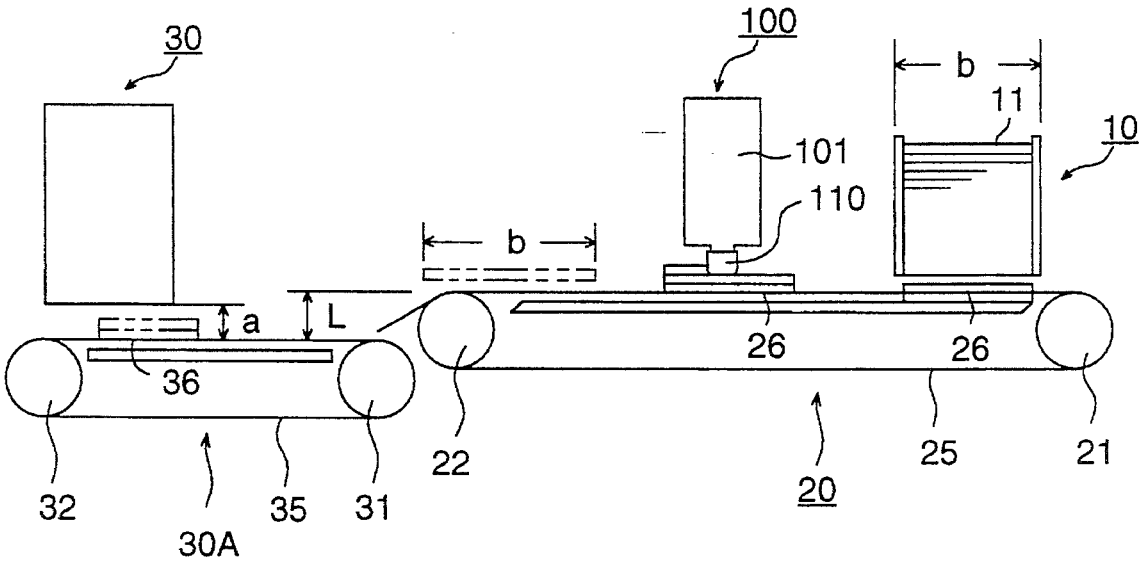

In the case of irradiation of energy rays in an arrangement shown in FIG. 1, when shielding conditions are not perfect, it sometimes happens that energy rays leak and cause coating solution 102 in the coating unit 110 in coating process to be set. Therefore, the processing unit 30 and the coating unit 110 both mentioned above are positioned along the curved conveyance path of the conveying unit 20 as shown in FIG. 2 (A). Owing to this, it does not happen that energy rays leaking crosswise cause the coating solution on the coating member to be set, even when the shielding conditions are not satisfactory slightly.

Another method is shown in FIG. 2 (B) wherein when step L is provided between the card-conveyance surface of the aforementioned belt or chain 25 in the course of passing the coating unit 110 and the card-conveyance surface of endless belt 35 stretched over driving wheel 31 and free wheel 32 of conveyance unit 30A in the course of passing the processing unit 30, and a distance between the bottom surface of the processing unit and the card-conveyance surface is assumed to be "a", it is possible to obtain the same effect as in FIG. 2 (A) when the relation of $a < L$ is satisfied. When the relation of $1<b/3$ is satisfied under the condition that a length of the card in its advancing direction is assumed to be "b", the card advances smoothly from the card-conveyance surface of the aforementioned endless belt or chain 25 to the aforementioned endless belt or chain 35. When a light-shielding plate which is not illustrated is provided, in addition to the method shown in FIG. 2 (B), in the vicinity of the card-conveyance surface so that it may not become a bar to card conveyance, the light-shielding plate thus provided makes one feel reassured more about avoidance of harm caused by leakage of energy rays.

Further, the processing unit 30 may also be provided in the vicinity of coating means 100 as a separate unit separated from a coating apparatus.

Various structures for coating means 100 in the invention will be explained as follows.

Figure 3:
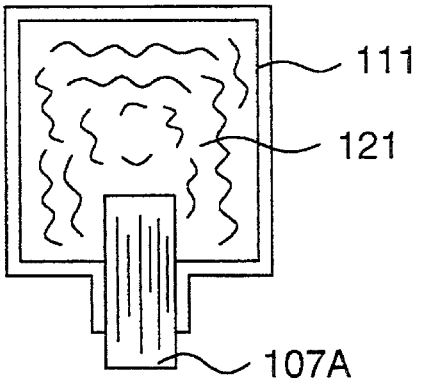
FIG. 3 is a side sectional view of an example of a coating means.

FIG. 3 represents a side sectional view of an example of the coating means 100 wherein coating solution tank 101 contains therein internal member 121 and coating solution 102, and a coating unit is provided with coating member 107A composed either of porous fibrous substance such as felt, nonwoven substance or cotton, or of fibrous fabric such as velvet or woven cloth called velvet or suede. Thus, coating solution 102 may be coated on card-shaped object to be coated 11.

Figure 4:
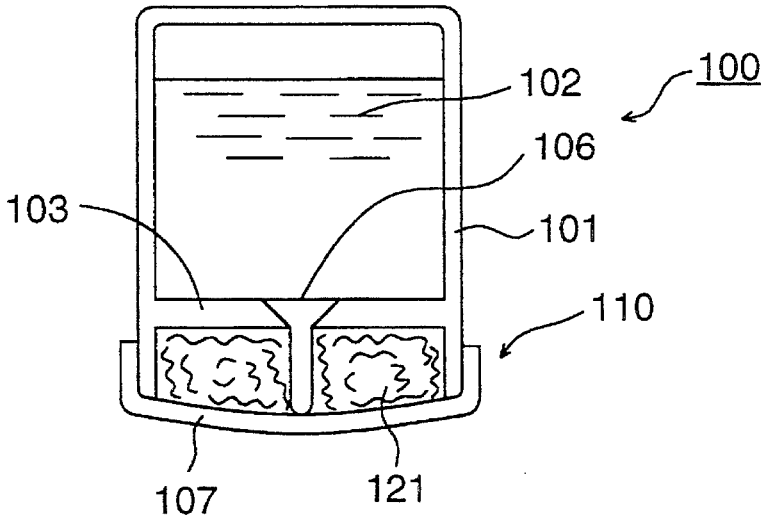
FIGS. 4(A) and 4(B) are side sectional views of another example of a coating means.
Figure 4:
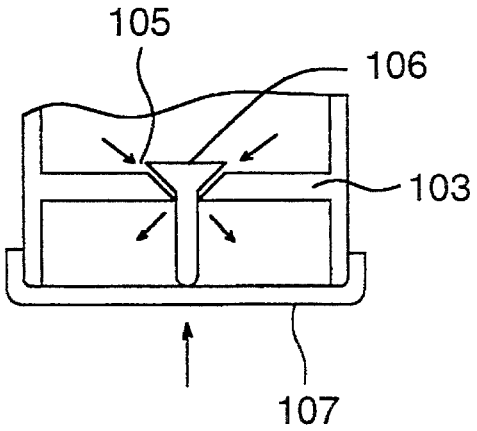

Each of FIG. 4 (A) and FIG. 4 (B) represents a side sectional view of coating means 100 of another example. A coating solution tank and coating unit 110 are separated by vertical partition 103 to be of an integral structure. The bottom thereof is covered by coating member 107 composed of porous fibrous substance or of fibrous fabric such as velvet or woven cloth called velvet or suede. As shown in FIG. 4 (A), small tapered hole 105 is provided at the center of intermediate partition 103, and piston 106 is engaged with the tapered hole 105 so that the lower end of the piston is in contact with and is pressing down an internal surface of the aforementioned coating member 107. When coating, the piston 106 is lifted through the coating member 107 of the coating unit 110 in the arrowed direction as shown in FIG. 4 (B), and coating solution 102 oozes out through a clearance formed between the piston 106 and the tapered hole 105. In the case of non-coating, the piston 106 falls with its own weight, eliminating the clearance between the tapered hole 105 and the piston. Thus, the coating solution stops oozing out.

Inside the coating unit 110, there is provided internal member 121, and coating solution 102 in quantity necessary for one sheet supplied when the piston 106 is opened as shown in FIG. 4 (B) is absorbed temporarily in the internal member 121, thus prevention of leakage of solution is further assured. An amount of coating solution to be fed out can be adjusted variously by an taper angle of the piston and the number of pistons. Preferable materials for the internal member 121 include fibrous fabric of woven cloth or fibrous substance such as sponge, cotton, nonwoven fabric and others.

Figure 5:
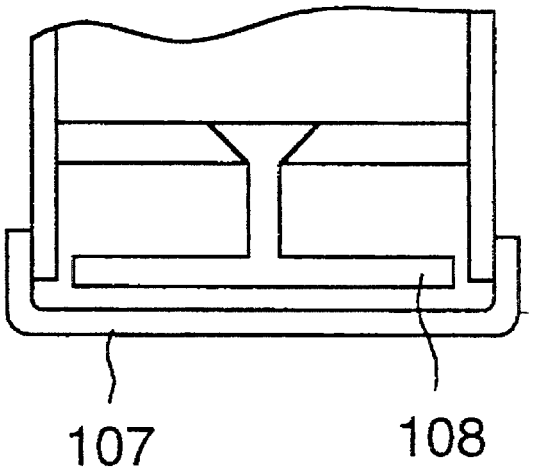
FIG. 5 is a partial side sectional view of an example of a coating means.

In the example shown in FIG. 4 (B), card-shaped object to be coated 11 comes in contact with coating member 107 and pushes the piston up. When coating under the condition mentioned above wherein a protruded portion on the coating member 107 caused by the lower end of the piston 106 is in pressure-contact with the card-shaped object to be coated 11, longitudinal coating streaks are caused at almost the center of the card-shaped object to be coated 11 in its advancing direction. In the example shown in FIG. 5 wherein the above-mentioned problem is prevented, there is provided integrally, when possible, bar 108 or a net that brings an object to be coated into laterally uniform contact with the coating member. Owing to this, the phenomenon that the central portion alone of the coating member 107 comes in pressure contact with the card is eliminated, and thereby the cause for longitudinal streaks is dissolved, resulting in excellent coating.

Figure 6:
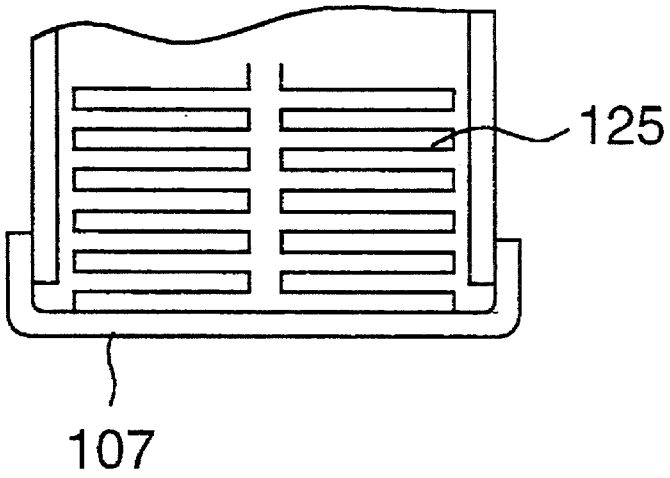
FIG. 6 is a partial side sectional view of another example of a coating means.

As another means, it is possible to dissolve anxiety for longitudinal streaks and to eliminate solution leakage phenomena by inserting resisting member 125 that is for keeping balance with surface tension that causes coating solution 125 to ooze out so that the resisting member may touch the upper portion of the coating member 107 as shown in a side sectional view in FIG. 6.

Supply of coating solution 102 from coating solution tank 101 on an on-demand basis is made by piston 106 as stated above. However, the number of the hole through which a coating solution is supplied by a piston is only one. Under this condition without taking any action, much coating solution 102 flows into the central portion directly, resulting sometimes in thick coating at the central portion and thin coating at peripheral portions.

Figure 7:
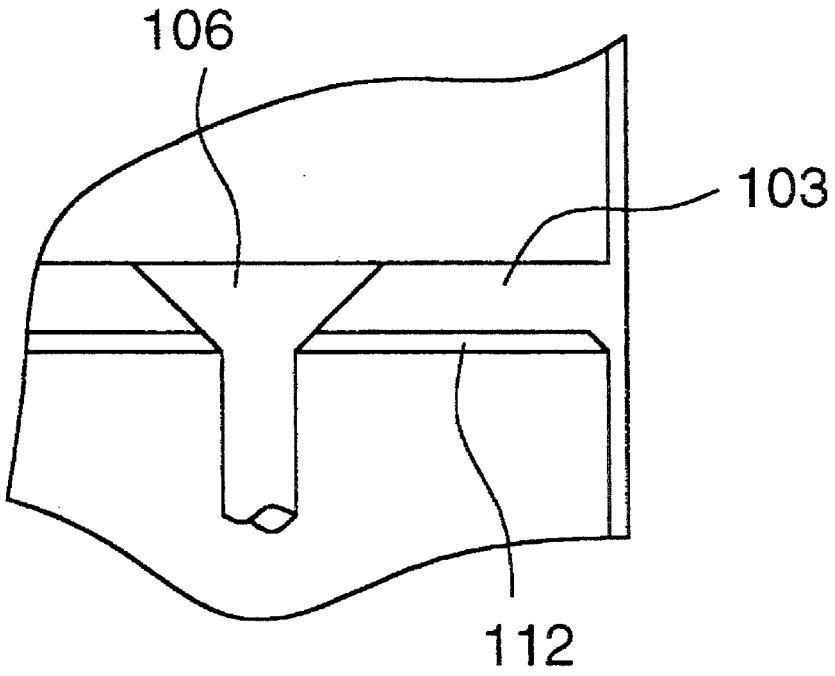
FIG. 7 (A) is a side sectional view showing a slit groove on a coating unit.
Figure 7:
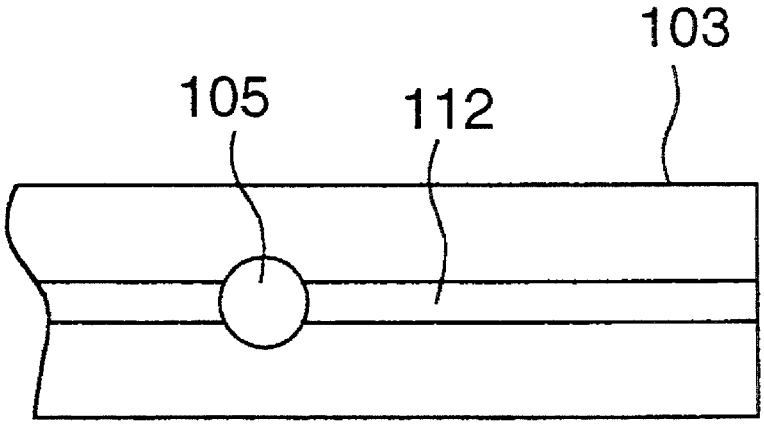

In order to prevent the foregoing, slit groove 112 is provided crosswise from the tapered hole 105 as shown in a side sectional view in FIG. 7 (A) and in a plan view of partition 103. This slit is so narrow in gap that a solution tends to spread to the periphery due to a capillary phenomenon. Therefore, uniformity of distribution of coating solutions in the lateral direction can be achieved.

Figure 8:
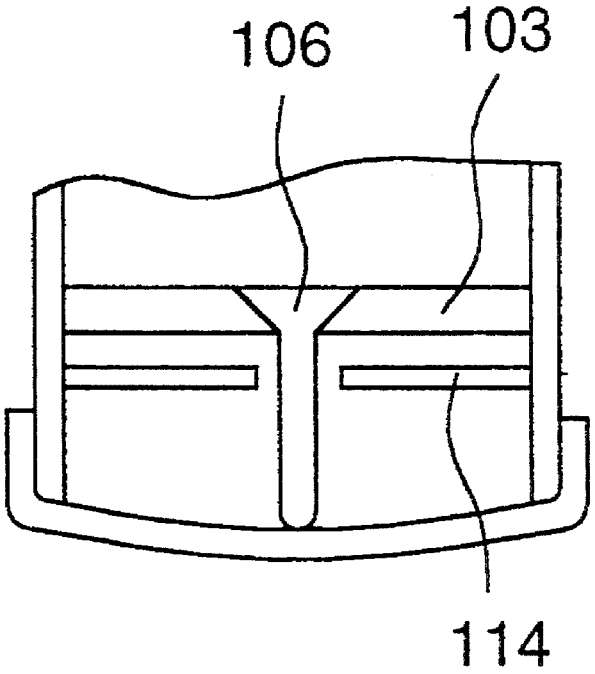
FIG. 8 (A) is a partial side sectional view showing how a diffusion plate is inserted in a coating unit.
Figure 8:
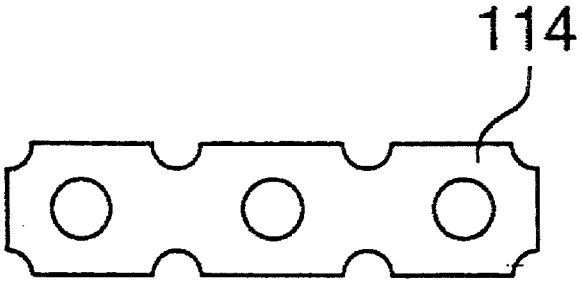

In order to improve uniformity of distribution of coating solutions in the lateral direction likewise, diffusing plate 114 as shown on a plan view in FIG. 8 (B) was arranged in the coating unit 110 as shown on a side sectional view in FIG. 8 (A), which proved to be effective.

Further, with regard to supply of coating solutions from coating solution tank 101 to coating unit 110, a solenoid (i.e., electromagnetic) valve may be used, or a valve may be opened and closed through mechanical cam driving, or further, a method to use a rotary pump for supplying a constant amount of solution through a solution-conveying tube may also be employed, in addition to a method of piston 106.

UV-setting resins of an epoxy type, for example, were used on the present coating apparatus as a coating solution, and when a PET card having a thickness of 500 μwas coated with a target layer thickness of 10 μm, a layer thickness at the trailing edge of the layer was not increased and a uniform protective layer was formed on the surface of the card.

However, when the resins identical to the foregoing were coated on a card identical to the foregoing with a target layer thickness of 15 μm by the use of a roll coater disclosed in Japanese Patent O.P.I. Publication No. 90266/1989, an increase in layer thickness of 30 μm appeared on the trailing edge of the card, causing the total layer thickness on the trailing edge to be 45 μm.

Incidentally, in the invention, it is preferable that coating unit 110 and coating solution tank 101 are structured integrally because they can be replaced on a cartridge type basis and coating solutions can be handled more simply.

Owing to the invention, a coating solution in a constant and necessary amount for coating can be supplied for the coating, the coating solution oozes out through a coating member to be coated on a card-shaped object to be coated, neither solution dripping nor solution leakage takes place during non-coating, and the coating solution spreads evenly on the card in the course of coating, making the stable and efficient coating possible for a protective layer on the surface of the card. In particular, no problem of layer thickness at the trailing edge takes place, and a high quality card which is protected by a beautiful protective layer and is excellent in durability, waterproofing and resistance for chemicals properties has been realized.

In addition to the above, a coating apparatus which is simple and is handled easily has been realized by making a coating means to be of a cartridge type.

There has been eliminated coating harm caused by irradiation leakage from a processing unit where energy rays are irradiated, thereby, it has become possible to provide a stable coating apparatus.

Preferable examples for a coating member will be explained as follows.

When a fibrous substance such as felt, nonwoven fabric or cotton is used as a coating member, irregular coating mottles appear on the coated surface because of uneven distribution of fibers in the fibrous substance. Further, when replacing a cloth-shaped coating member, the coating member being wet with a coating solution has sometimes stained the surroundings.

In the invention, porous and fibrous substances or fibrous fabrics such as woven cloths are used as a coating member. Among the fibrous fabrics, a fabric having pile called moquette, brush velour, seal, velvet or suede, namely the so-called velvet is on the most preferable condition. Namely, it makes uniform coating possible and makes coating finish stable, offering beautiful appearance.

With regard to materials for velvet, especially materials for pile, polyester, rayon and nylon are preferable, and among them, polyester and rayon offer excellent coating finish. A length of pile ranging from 1 mm to 5 mm is preferable. With regard to fiber density, the density ranging from 30 threads–80 threads per 1 inch is preferable for warp, and one ranging from 20 threads to 70 threads per 1 inch is preferable for weft.

Figure 9:
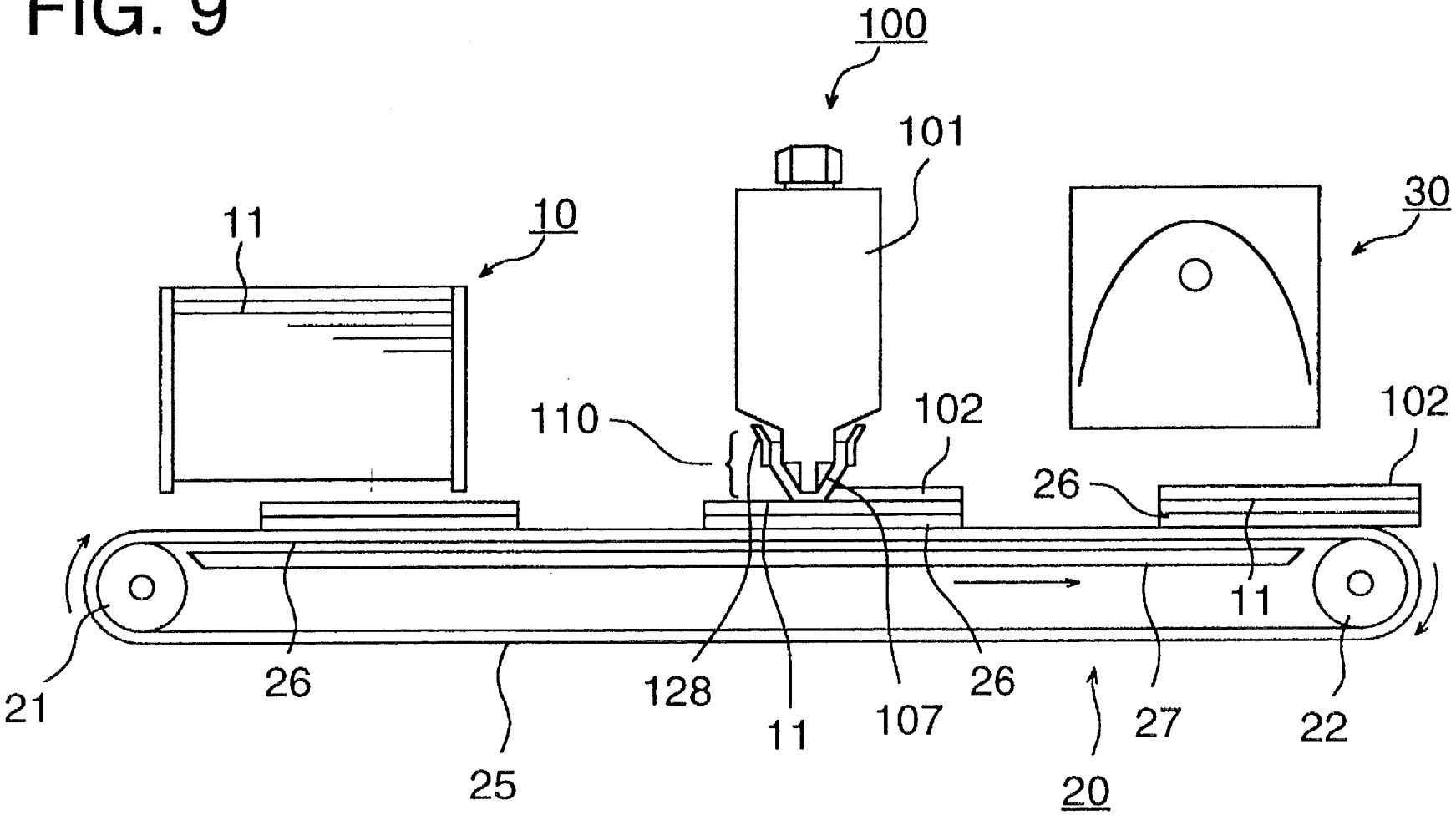
FIG. 9 is a front view showing an outline of the total constitution of an example which attains the second object of the invention.

Velvet used as coating member 107 shown in FIG. 9 made coating uniform and stable. However, even velvet, when it is used for many times of coating, such as, for example, 5,000 sheets of cards or 10,000 sheets of cards, it deteriorates with its pile falling down or worn out short. In that case, the velvet needs to be replaced with new one.

Figure 10:
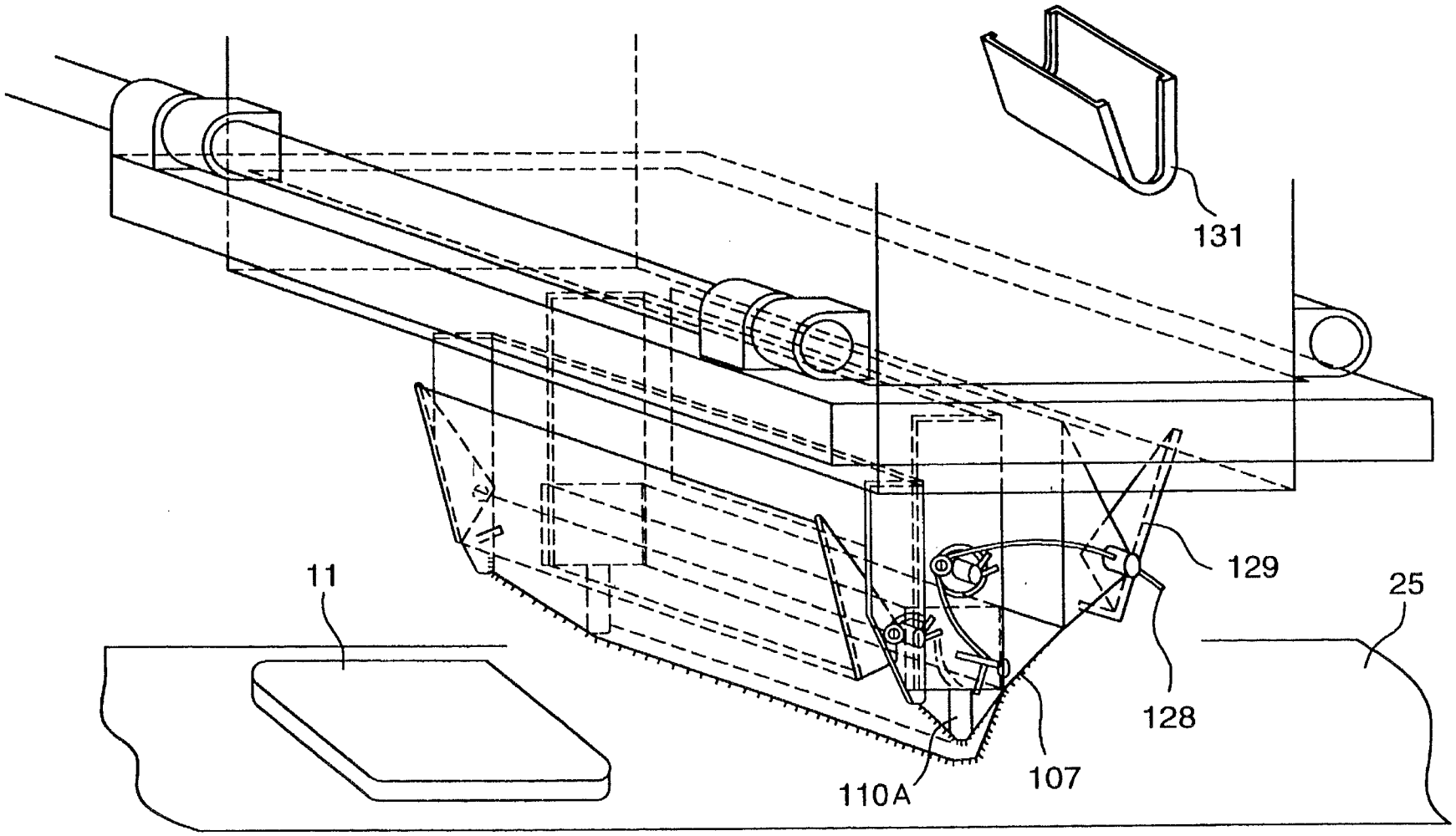
FIGS. 10(A) and 10(B) are respective perspective views for a coating unit and a fixing jig for a coating member showing the structure wherein coating members can be replaced.

The replacement mentioned above is required to be made smoothly, easily and safely. The method and apparatus therefor will be explained as follows, referring to a front view in FIG. 9, a perspective view of a coating unit in FIG. 10 (A) and a perspective view of a jig in FIG. 10 (B).

In this case, coating member 102 is prepared in advance to be a sheet cut in a leaf shape, and when the coating member 107 is deteriorated, clip 128 is squeezed to release pressure and new sheet-shaped coating member 107 is first fitted on the internal surface of jig 131.

Then the clip is squeezed and the jig 131 is fitted in holder 110A of the coating unit 110. After that, when the clip is released, velvet of the new coating member 107 is caught by the clip 128 against holder 110A, and the coating member 107 is brought into pressure contact with holder 110A by spring 129 with an appropriate tension, thus,the new coating member 107 is affixed on the holder 110A to be in close contact therewith.

Thereby, the accurate and easy mounting of the new coating member 107 can be completed by drawing out the jig 131. In this case, an internal surface of the jig 131 and an external surface of the holder 110A are similar in shape each other with velvet of the coating member 107 sandwiched between them.

Figure 11:
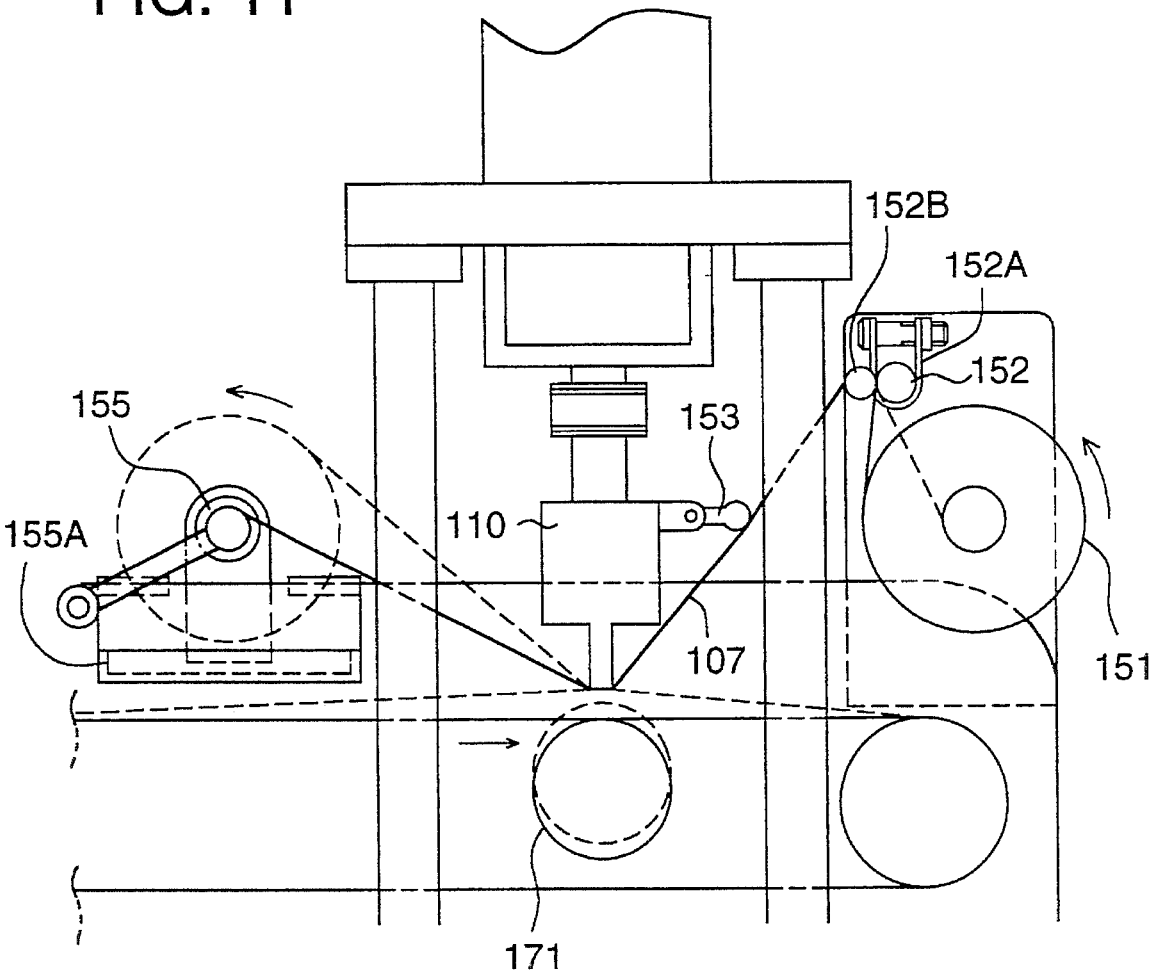
FIG. 11 is a front view of a coating apparatus wherein a coating member in a long roll shape is loaded in a replaceable manner.

The aforementioned is for the example for the method of replacing coating member 107 in a leaf shape and for an apparatus. What is shown on a front view in FIG. 11, on the other hand, is one wherein coating member 107 is of a long reel type and is set in a supply reel. When a coating member is deteriorated, in this case, the deteriorated coating member is moved toward a take-up shaft of a take-up reel and new coating member is supplied for replacement for the deteriorated one.

Namely, coating member 107 of a long roll type is set on supply roller 151 and is chained by over-rotation brake 152A, thus coating member 107 in necessary amount for replacement is taken out by supply roller 152 that is pressed by supplied amount indicating roll 152B. The coating member, on the other hand, is taken up, through tensioner 153 and coating unit 110, by take-up shaft 155 which is prevented from rotating reversely by a one-way clutch. Namely, the deteriorated one is taken up and new one is supplied from the supply roller 151.

The coating member taken up is wet with a coating solution and the solution sometimes drips. Therefore, solution receiver 155A is provided under the take-up shaft.

Incidentally, in coating unit 110, coating member 107 lifts belt 25 of conveying unit 20 when a card to be coated arrives at a coating unit so that the card may be brought into contact with the coating member 107 at an appropriate pressure, and thereby, coating of a superficial protective layer which is stable and uniform is completed.

Figure 12:
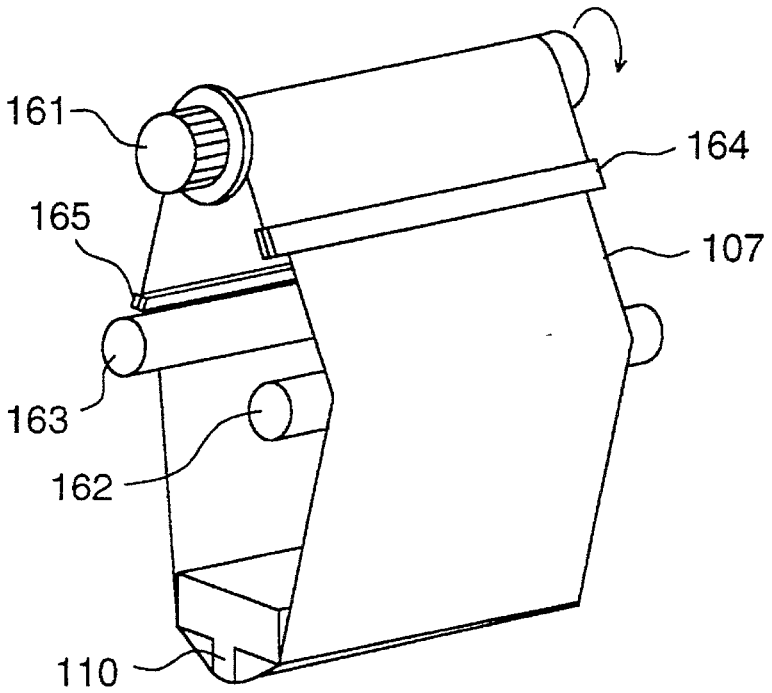
FIG. 12 is a perspective view of a coating unit wherein a coating member in an endless belt shape is loaded.
Figure 13:
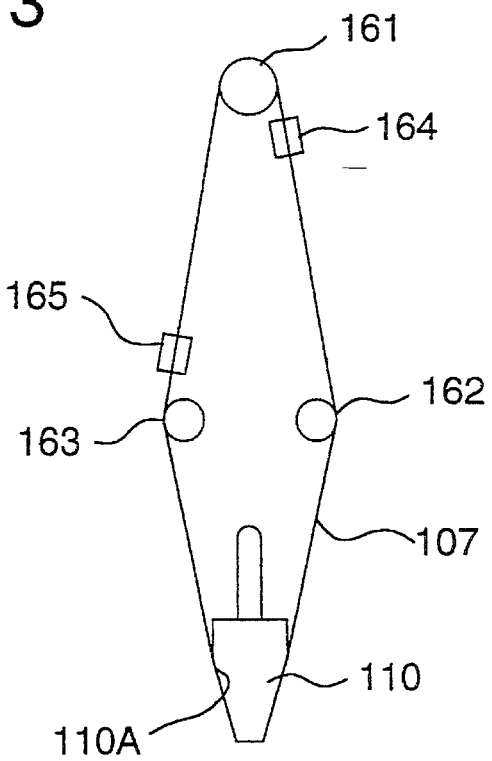
FIG. 13 is a front view of a coating unit wherein a coating member in an endless belt shape is loaded.

Each of a perspective view in FIG. 12 and a front view in FIG. 13 shows velvet of coating member 107 wherein the velvet is clamped by clips 164 and 165 provided at both ends of a leader belt to be an endless belt which is stretched around driving roller 161, guide rollers 162 and 163 and holder 110A of coating unit 110. When the velvet portion is deteriorated, that portion can be replaced with new one when a knob provided on the driving roller is rotated in one direction by a constant amount. The endless belt can also comprise only coating member 107, without being provided with a leader belt.

Owing to the present example, when a coating member is deteriorated, a means for replacing with new one can be made simple, accurate and easy to operate.

Preferable examples of a coating solution supplying unit will be described as follows.

In the case of an apparatus wherein a coating solution is caused to ooze out from a fibrous substance or a fibrous fabric for direct coating, an amount of a coating solution supplied from the coating solution tank to a coating unit varies depending on the change in a height of a level in a coating solution tank, causing finish of a card to be changed with time.

In a coating apparatus having coating rolls described in Japanese Patent Application Nos. 90261/1989 and 90266/1989, there are provided a pick-up roll for supplying coating solutions to the coating rolls and a coating solution vat into which the pick-up roll is dipped. In this case, a coating solution is supplied to the coating solution vat from a coating solution tank prepared separately by means of a solution-conveying pump or the like. However, for controlling an amount of solution to be supplied to the coating solution vat, it is necessary to provide a separate mechanism such as a level sensor capable of detecting a height of a level in the coating solution vat. When supplying coating solutions directly to the coating solution vat, it sometimes happens that solutions are spilled and stain surroundings.

In the case of an apparatus wherein a coating solution is caused to ooze out from a fibrous substance or a fibrous fabric for direct coating on a card, an amount of coating based on a coating solution oozed out depends largely upon flow resistance for a coating solution in a fibrous substance or a fibrous fabric, and the flow resistance is closely connected to a height of a level in the coating solution tank. Therefore, when an amount of supply of the coating solutions changes with time, it is impossible to keep the coating thickness at the predetermined level. Especially, a height of a level in the coating solution tank becomes lower as coating goes on, and it is necessary to provide a means that opens or closes a valve so that time for supplying coating solutions may be adjusted depending on the height of a level.

The means mentioned above increases cleaning operations and makes the structure complicated. In addition, when supplying coating solutions into a coating solution tank, the solution tends to spill and stain surroundings, causing the cleaning to be time-consuming.

Referring to a front view in FIG. 14 and sectional views in FIGS. 15 and 16, there will be explained constitution of the invention wherein coating solution 102 is supplied from coating solution bottle (container) 181 into coating solution vat 101A in which the height of a level of the coating solution is kept to be constant.

The coating solution bottle (container) 181 is sealed on end 183 of its opening with sealing material 183A made of metallic foils and ethylene materials both laminated, and it is capped so that it may be marketed through distribution.

Figure 14:
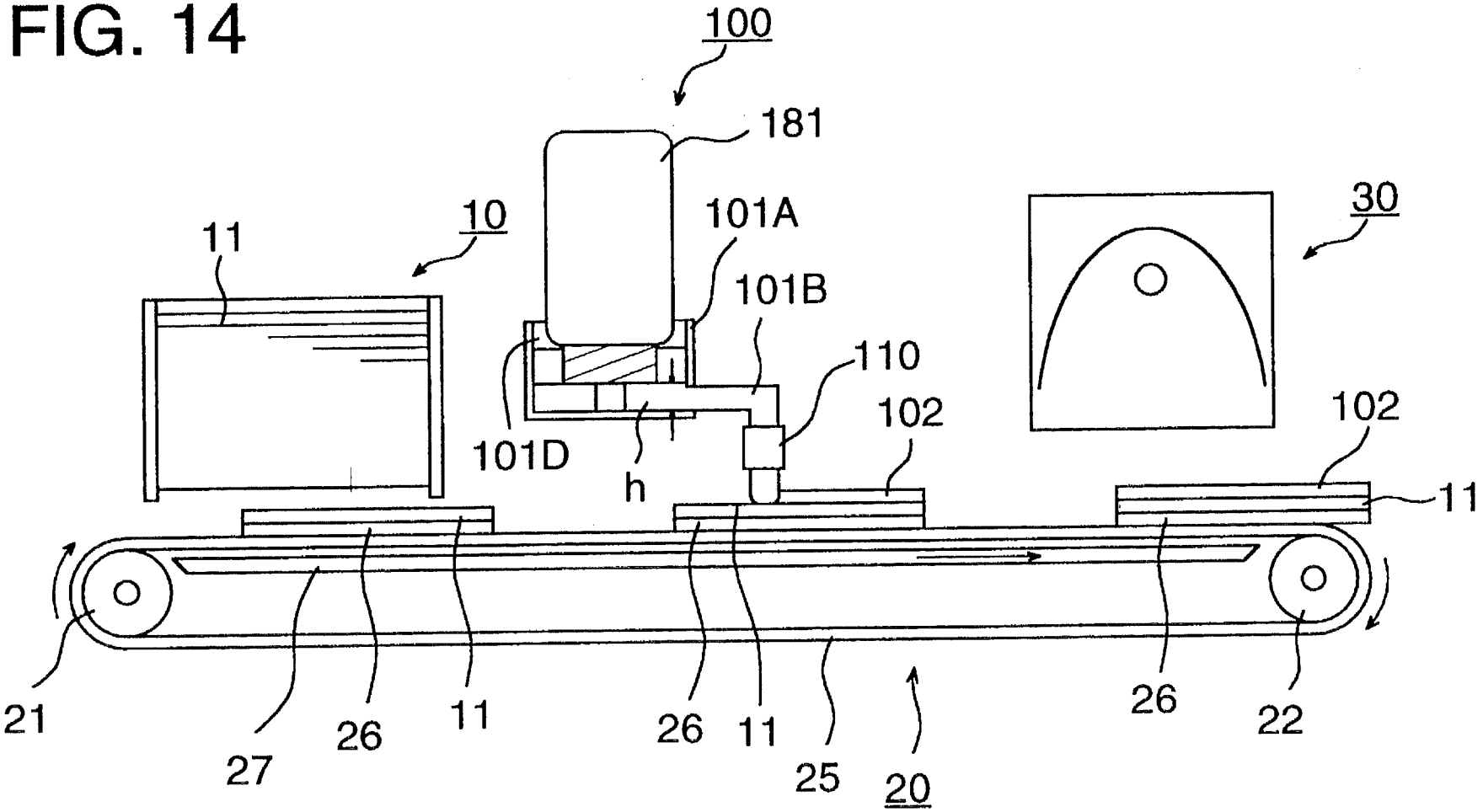
FIG. 14 is a front view showing an outline of the total constitution of an example that attains the third object of the invention.

When the coating solution bottle (container) 181 is set on the coating solution vat 101A with the opening end 183 facing downward after a cap is removed, the coating solution bottle is placed on positioning bracket 101D of the vat 101A shown in FIG. 14 to be fixed in terms of location. In this case, the end 183 is at the height of h from the bottom of the vat 101A. Concurrently with the foregoing, the selling material 183A is broken by hollow-pipe-shaped pin 184 that is planted in the coating solution vat 101A and is shaved sharply. Slit 184A is formed on the hollow pipe along the length thereof, and coating solution 102 flows out through the unsealed opening end 183 into the coating solution vat 101A. Supply of a coating solution is stopped when the height of a level of the coating solution reaches the height h up to the opening end 183 to be balanced therewith.

Since there is surface tension between coating solution 102 itself and its end surface, the height of a level can not be the height of h exactly, but it can be in the vicinity of the height h.

The coating solution 102 in the coating solution vat 101A is communicated with coating solution tank 101 through pipe 101B, and is coated on a card which is member to be coated 11 by coating member 107 through coating unit 110. When this is repeated and the height of a level h of the coating solution 102 in the coating solution vat 101A is lowered, air enters the bottle 181 through the clearance of opening end 183 of the coating solution bottle 181, and the height of a level h of the coating solution 102 supplied into the coating solution vat 101A is restored to h to be balanced. At this moment, the supply is stopped. As stated above, each time a coating solution is coated on an on-demand basis, coating solution 102 equivalent to that in coating solution vat 101A consumed in each coating is replenished on an on-demand basis from the coating solution bottle 181. Therefore, the height of a level in the coating solution tank is set to the position of the opening end of the coating solution bottle to be stable, making it possible to coat accurately with a uniform thickness of a coated layer, thus coating of a protective layer for high quality card-shaped object to be coated 11 is completed.

Figure 15:
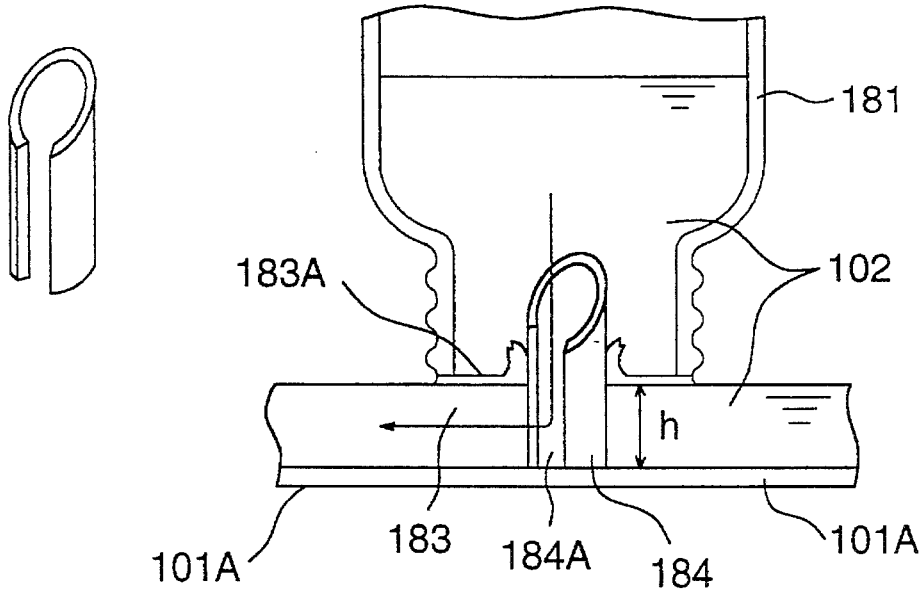
FIG. 15 is a partial sectional view showing how a coating solution bottle is mounted in a coating solution vat.
Figure 16:
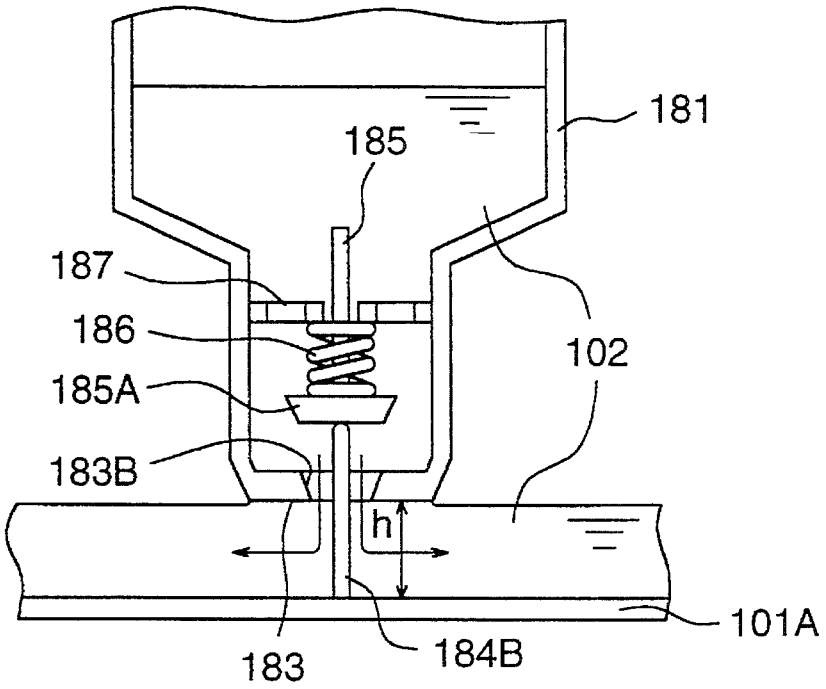
FIG. 16 is a partial sectional view showing how a coating solution bottle of an another type is mounted in a coating solution vat.

The portion in the vicinity of an opening of coating solution bottle 181 may be structured as shown in a sectional view in FIG. 16, without being those shown in FIG. 15.

Namely, opening end 183 is provided with tapered hole 183B, and piston bar 185 having tapered surface engaging with the tapered hole 183B is constantly urged toward the end 183 by spring 186 and bearing member 187 provided on the opening, so that the opening may be constantly closed.

When the coating solution bottle 181 is set, with its opening end 183 facing downward, on positioning bracket 101D, the piston bar 185 mentioned above is lifted by pin 184B planted on the vat 101A, and a clearance is formed at the tapered portion of the opening, thus coating solution 102 is supplied through the process similar to that shown in FIG. 15, and the height of a level h thereafter is kept by coating solution 102 replenished constantly on an on-demand basis.

UV-setting resins of an epoxy type, for example, were used on the present coating apparatus as a coating solution, and when a PET card having a thickness of 500 μm was coated with a target layer thickness of 10 μm, a uniform protective layer was formed on the surface of the card.

Further, cards each having an external protective layer with uniform finish were formed until the moment when coating solution in coating solution container 181 is used up.

Incidentally, in the invention, it is preferable that coating unit 110 and coating solution tank 101 are structured integrally and coating solution vat 101A communicated with the coating solution tank 101 through pipe 101B is structured separately.

Figure 17:
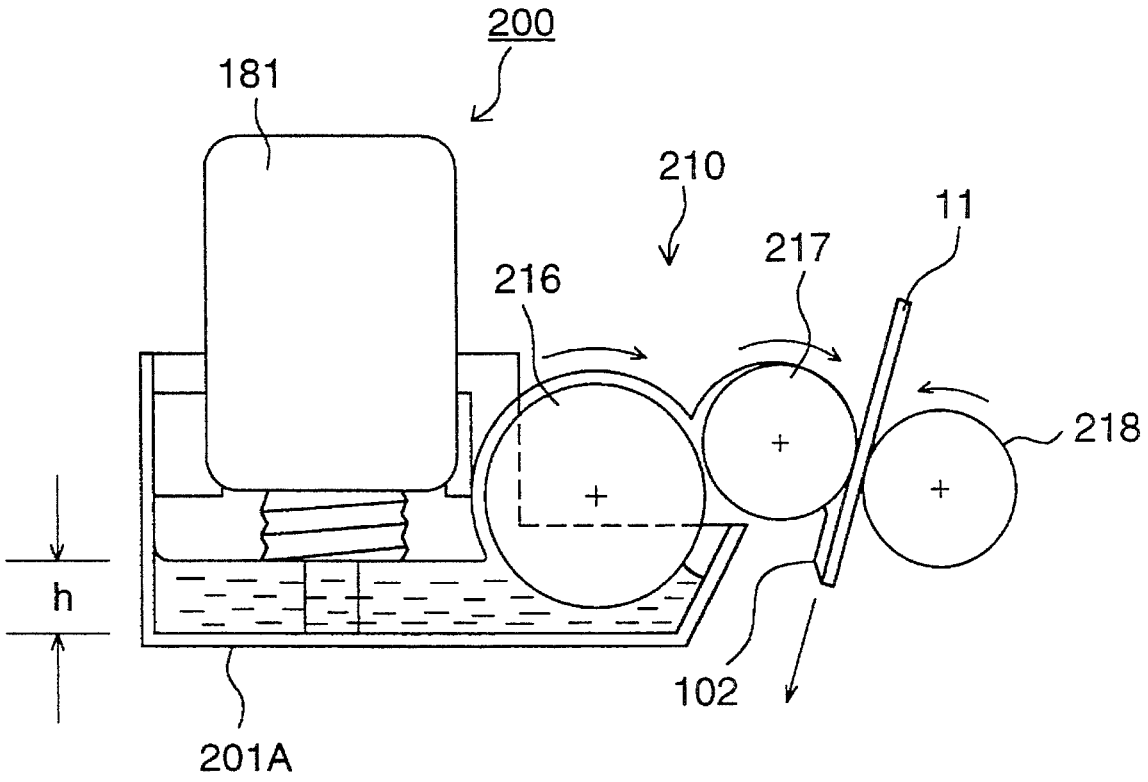
FIG. 17 is a side sectional view showing an example of a coating apparatus of a roll coating type.

FIG. 17 is a side sectional view of an example wherein a supply unit of the invention is applied on coating unit 210 of coating apparatus 200 of a roll coating type. Card-shaped object to be coated 11 conveyed from the upstream side is transported while it is sandwiched between coating roll 217 and back roll 218, and coating solution 102 is transferred from the coating roll 217, thus, an external protective layer is formed. Supply of coating solution to the coating roll 217 is conducted by pick-up roll 216 located at the position where one portion of the pick-up roll is dipped in a coating solution in a coating solution vat.

Supply of coating solutions into coating solution vat 201A and control of the height of a level h were conducted through the method explained and described previously in FIGS. 15 and 16.

UV-setting resins of an epoxy type, for example, were used on the present coating apparatus as coating solution 102, and when a PET card having a thickness of 500 μm was coated with a target layer thickness of 15 μm, a uniform protective layer was formed on the surface of the card.

Further, cards each having an external protective layer with uniform finish were formed until the moment when coating solution in coating solution bottle 181 is used up.

Owing to the invention, coating solutions in a constant amount necessary for each coating is supplied when coating, the coating solutions are coated on a card-shaped object to be coated by means of each coating means, coating solutions equivalent to those consumed are replenished on an on-demand basis so that the height of a level in a coating solution vat may be kept to the same level, thereby stable balance of coating solutions can constantly be kept, coating solutions spread over the card uniformly when coating, thus a protective layer on the card surface is coated stably and efficiently, and a high quality card which is protected by a beautiful protective layer and is excellent in durability, waterproof and resistance for chemicals properties has been realized.

Further, it has become possible to supply coating solutions neatly into a coating solution tank simply, surely and easily without spilling them.

An example attaining the fourth object of the invention will be described as follows. In an apparatus wherein a coating solution is oozed out of a fibrous substance or a fibrous fabric to be coated directly on the surface of a card, an amount of a coating solution oozed out depends upon flow resistance in the fibrous substance. Therefore, changes with time in pressure for supplying a coating solution and viscosity of the coating solution are caused by fluctuations of a level of a coating solution and temperature in a coating solution tank, resulting in a fear that an amount of a coating solution supplied may fluctuate and a thickness of a coated layer can not be kept at a predetermined one accordingly.

Figure 18:
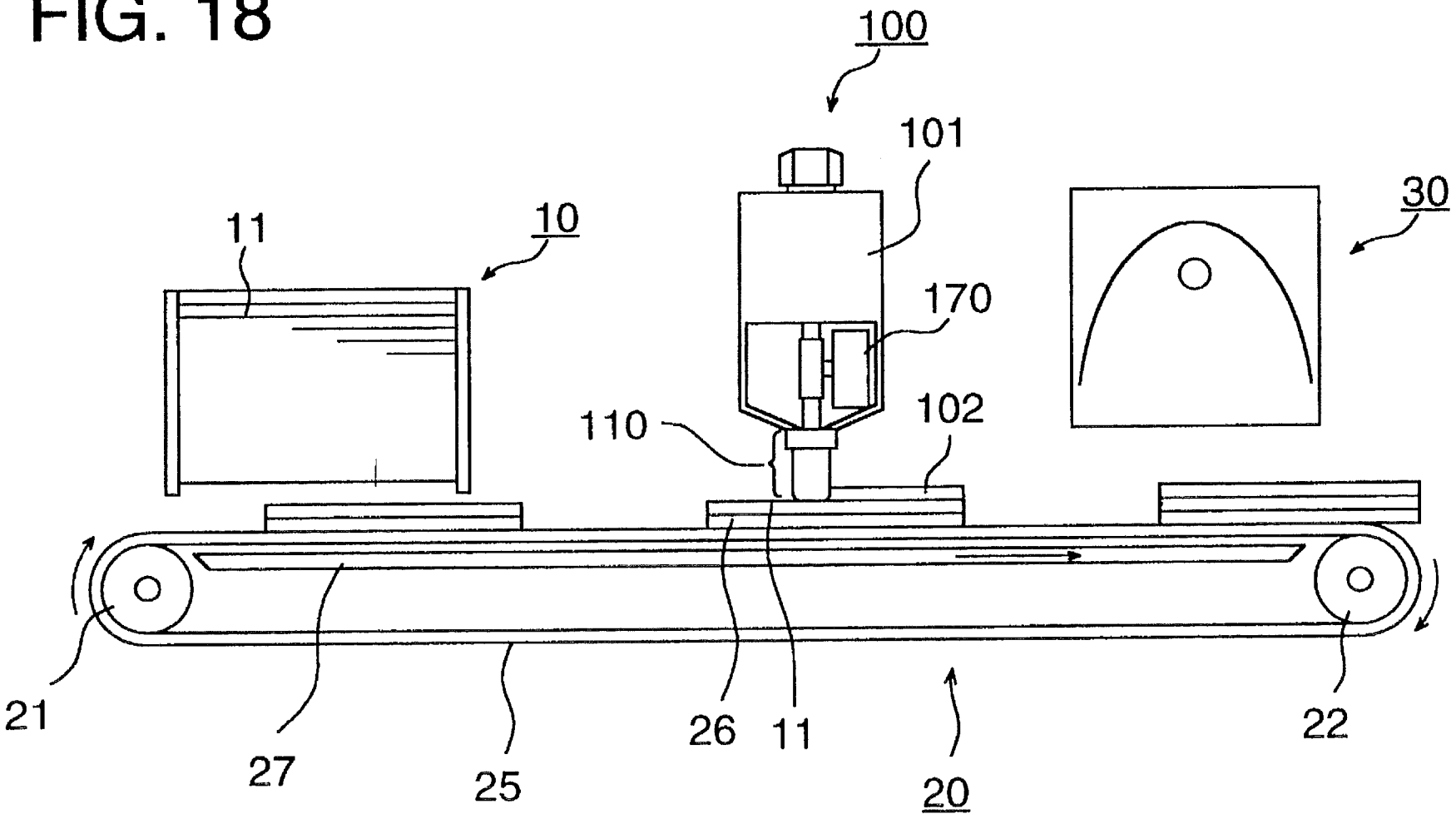
FIG. 18 is a front view showing an outline of the total constitution of an example of the invention attaining the fourth object of the invention.

Then, in the example shown in FIG. 18, coating unit 110 of coating means 100 is slightly depressed at a coating position, coating member 107 located at the bottom of the coating unit 110 and a pallet or a card-shaped object to be coated 11 on stage 26 are brought into contact with each other crosswise under uniform pressure, a necessary amount of coating solution 102 is supplied from coating solution tank 101 when solenoid (electromagnetic) valve 170 is opened for a predetermined period of time in appropriate timing, and coating solution 102 oozed out on the coating member 107 is transferred to be coated uniformly onto the card-shaped object to be coated 11 on the moving pallet or on the stage 26. When the trailing edge of the card-shaped object to be coated 11 approaches, the solenoid (electromagnetic) valve 170 is closed synchronously with that approach, and when the trailing edge arrives, communication of the coating unit 110 with the coating solution tank 101 is cut, thus, coating is ended.

In the present example, coating solution tank 101, solenoid valve 170 and coating unit 110 are integrated, and they may naturally be moved up and down collectively. However, it is preferable that an object to be coated is moved up and down. It is a matter of course that coating solution tank 101, solenoid valve 170 and coating unit 110 are arranged to be separate form each other and connected by hoses.

When coatings solution pool (coating solution tank) 101 is sealed, there sometimes happens that an internal pressure is changed by ambient temperature change or the like, coating solutions are not supplied constantly and stable coating can not be performed. Therefore, it is preferable that the coating solution pool (coating solution tank) 101 is open to the atmosphere through its upper open hole 101A as shown in a sectional view of coating means 100 shown in FIG. 19.

To the coating solution tank 101 of the coating means 100, there is connected coating unit 110 through solenoid valve 170, and slit 121A inside the coating unit 110 is filled with internal member 121 that is soaked with coating solution 102 supplied when the solenoid valve 170 is opened. Under the cavity of the coating unit 110, there is set coating member 107.

Figure 19:
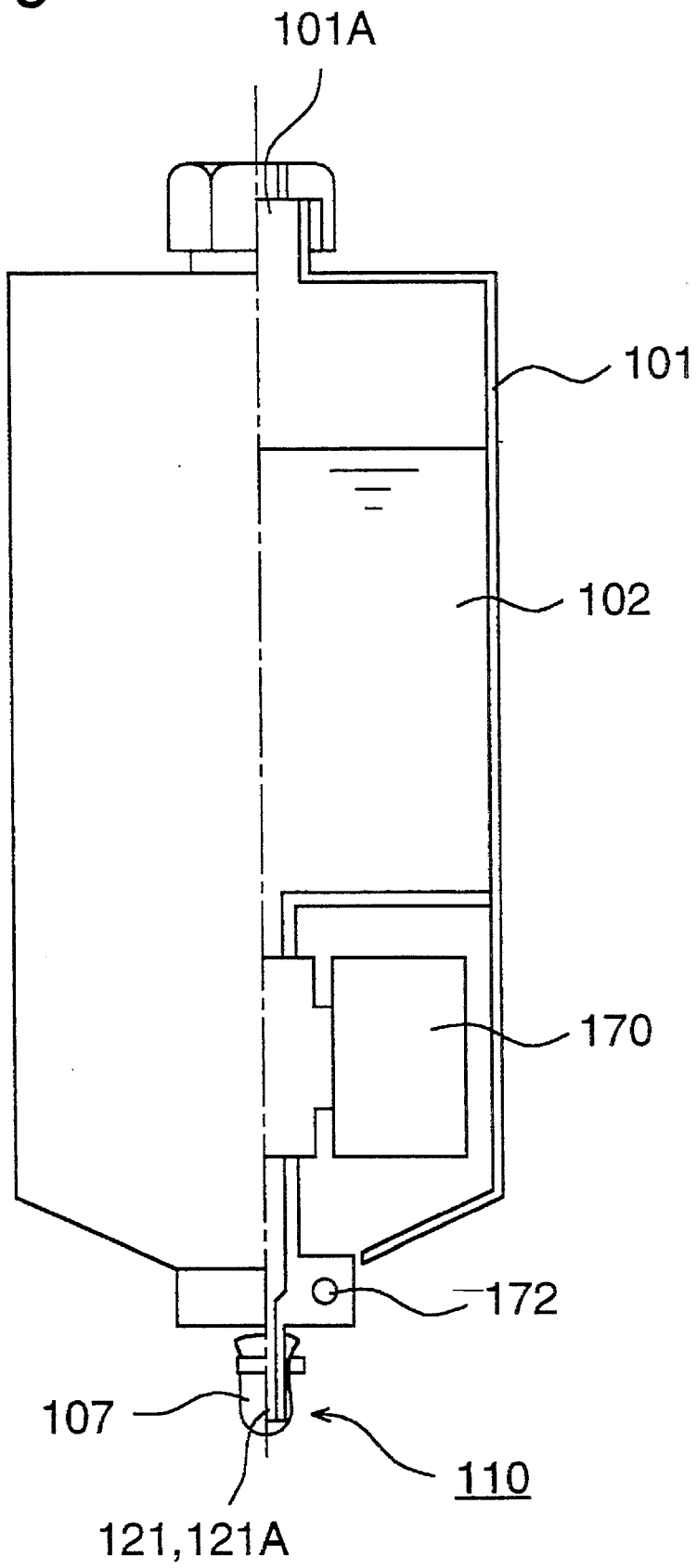
FIG. 19 is a sectional view of a coating means having therein a solenoid valve.

Next, a more detailed explanation will be offered as follows for how the method of the invention based on the constitution shown in FIGS. 18 and 19 works.

Figure 20:
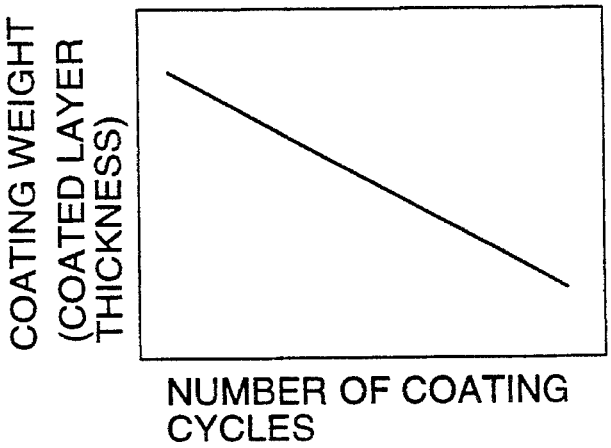
FIG. 20 is a graph showing the relation between the number of coating cycles and coating weight depending on the change in a level of a coating solution.

A graph in FIG. 20 shows how a coating weight (layer thickness) is reduced when the number of cycles of coating on card-shaped objects to be coated is increased and a level of a coating solution in coating solution tank 101 is lowered accordingly. This indicates that when a level of a coating solution is lowered under the condition of the constant releasing time of solenoid valve 170, an amount of supplied coating solution 102 that is oozed out to internal member 121 as a level of a coating solution is lowered is reduced, and the layer thickness is also reduced accordingly. It is understood that the number of coating cycles is related to a coating weight (layer thickness) linearly.

This hints that a layer thickness can not be kept at a predetermined value unless the releasing time for the solenoid (electromagnetic) valve 170 is controlled as occasion calls.

In the method described above, the supplied amount of a coating solution (layer thickness) is controlled to a predetermined value by a value obtained by detecting a level of a coating solution in coating solution tank 101 with a level meter, through the releasing time of solenoid (electromagnetic) valve 170.

On the contrary, it is also possible to change a coating weight (layer thickness) within the same card depending on the region, by controlling timing of the solenoid valve 170 utilizing that a coating weight (layer thickness) is changed depending on the releasing time of the solenoid valve 170. This method can also be applied to the occasion wherein a layer thickness of a specially important region within the same card is required to be thicker.

Figure 21:
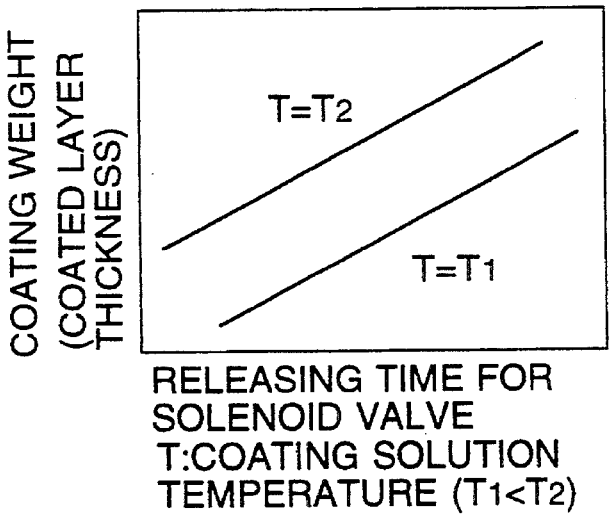
FIG. 21 is a graph showing the relation between coating weight with coating solution temperature as a parameter and the releasing time for a solenoid valve.
Figure 22:
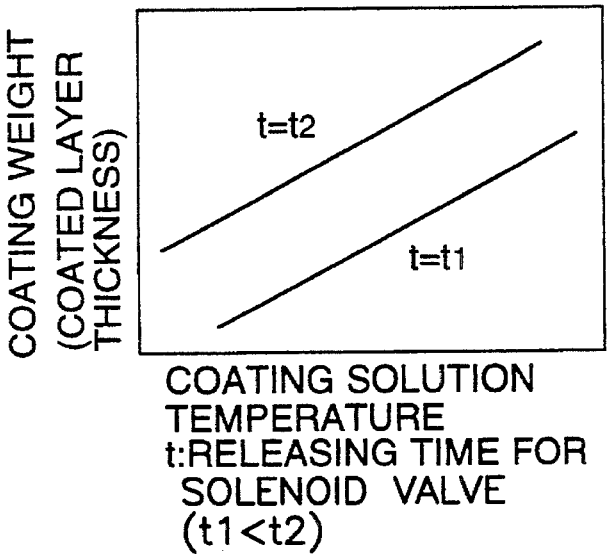
FIG. 22 is a graph showing the relation between coating weight with the releasing time for an electromagnetic valve as a parameter and the coating solution temperature.

A graph in FIG. 21 shows proportional relations between a coating weight (layer thickness) and releasing time of solenoid valve 170 with parameters of coating solution temperatures $T_1$ and $T_2$ ($T_2 > T_1$), while a graph in FIG. 22 shows proportional relations between a coating weight (layer thickness) and coating solution temperature with parameters of solenoid valve opening time $t_1$ and $t_2$ ($t_2 > t_1$).

In order to keep a coated layer thickness at a predetermined value without complicated control, therefore, it is understood that the releasing time of solenoid valve 170 is required to be controlled according to a level of a coating solution in coating solution tank 101, and the coating solution temperature is required to be kept at a predetermined value because viscosity of the coating solution is varied by the change of coating solution temperature.

As stated above, it is necessary to control coating solution temperature so that it may be kept at a predetermined temperature.

For keeping the coating solution temperature, either total solution including coating solution tank 101 may be kept at a constant temperature, or only a portion of a supply path for a coating solution including a part of coating unit 110 may be kept at a constant temperature. The latter is preferable because heater 172 can be made small for energy saving.

In the examples mentioned above, epoxy type UV-setting resins were used as a coating solution, and when coating with a target layer thickness of 10 μm on a PET card having a thickness of 500 μm as object to be coated 11, it was possible to prepare cards as object to be coated 11 with constant quality by keeping a coating unit at a constant temperature, by keeping the coating solution temperature at 40° C., and by changing releasing time t for solenoid valve 170 provided between coating solution tank 101 and coating unit 110 from 1 second to 3 seconds during the period wherein a level of a coating solution in the coating solution tank 101 changed from 100 mm to 10 mm.

In addition to the above, it was also possible to form a protective layer having different layer thickness partially, by changing the timing for opening an solenoid valve from the leading edge of a card to the trailing edge thereof, under the conditions mentioned above. Therefore, it has become possible to enhance further the effect to prevent altering, by making the important area to be thicker specially on the card.

Owing to the invention, level when a level of a coating solution in coating solution tank is changed, the releasing time for an solenoid valve can be controlled based on the changed of the level, thereby it has become possible to coat constantly and stably epoxy type UV-setting resins to be in a predetermined layer thickness on a card.

An applied means for changing a layer thickness within the same card by taking timing for opening an solenoid valve has also become possible. Further, for the problem that viscosity of a coating solution is varied by the change in ambient temperature and thereby the coating thickness is changed, it has become possible to coat on a card stably by heat-adjusting the entire coating means or a portion near the coating unit and thereby adjusting to an appropriate coating temperature.

Next, there will be explained mechanism wherein either a coating unit or a card-shaped object to be coated is moved to bring them into contact each other or to separate them.

Figure 23:
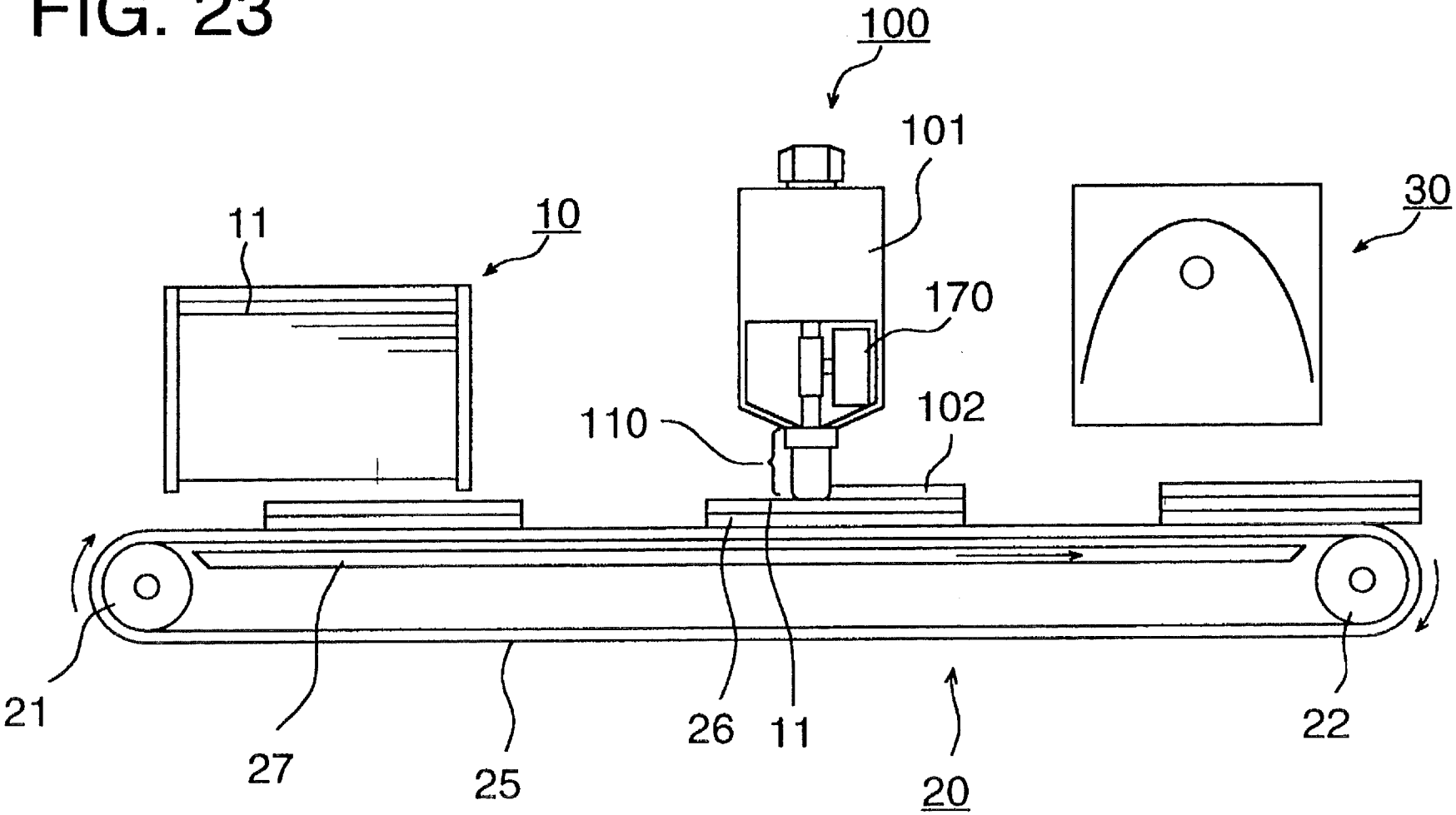
FIG. 23 is a schematic sectional view of a forming apparatus for a superficial protective layer relating to the first example attaining the fifth object of the invention.

FIGS. 23–26 show the first example of an external protective layer forming apparatus related to the invention, wherein FIG. 23 is a schematic side view of the external protective layer forming apparatus, FIGS. 24–27 represent side views showing how the external protective layer forming apparatus works in a UV resin coating process.

In each figure, F represents a card-shaped object to be coated with UV resins such as a driver's license, for example, and 301 is an endless belt for conveying card-shaped object F which is stretched around rollers **302*a* and 302*b*** arranged in front and in rear of the apparatus so that it is rotated in the direction of advancement of the work.

The numeral 303 is a rotating member attached to a first rotary solenoid (unillustrated), 304 is an L-shaped shaft whose one end is provided with rack 305 that is engaged with a periphery of the rotating member 303, and the shaft 304 is structured so that it may be reciprocated side by side by an operation of the rotary solenoid.

The numeral 306 is an adjuster provided on the other end of the shaft 304, the numeral 307 is a second rotary solenoid, and a rotating shaft of the second rotary solenoid 307 is provided with arm 308 whose tip is provided with rotatable roller 309. Namely, the roller 309 is rotated, by an operation of the second rotary solenoid 307, to the position where it comes in contact with the adjuster 306 so that the roller 309 may regulate a sliding position of the shaft 304 in the left direction. Incidentally, the sliding position of the shaft 304 can be adjusted precisely by the adjuster 306.

The first and second rotary solenoids are connected to a plurality of timer switches (not shown), and are operated by commands from the timer switches. Incidentally, a stepping motor or the like may be used as a driving means in place of a rotary solenoid.

The numeral 310 is an eccentric roller (cam) provided between the endless belt 301 and the shaft 304, and the eccentric roller 310 is rotated according to reciprocation from side to side of the shaft 304 so that the eccentric roller may lift the endless belt 301. Incidentally, the eccentric roller 310 may also be connected directly to a stepping motor without being interlocked with the shaft 304 so that the eccentric roller may regulate rotating angles. In addition, a lifting plate that is interlocked with a cam may also be used instead of an eccentric roller.

The numeral 311 is a sensor for detecting a position of card-shaped object F that is conveyed by the endless belt 301 while the card-shaped object is staying on the endless belt. This sensor 311 is also structured so that it is interlocked with timer switches to regulate the first and second rotary solenoids.

The numeral 312 is a tank in which UV resins are contained, and at the lower portion of the tank 312, there is provided a coating head 313 which is structured so that UV resins are supplied constantly from the tank 312 to the coating head 313. Incidentally, the coating head 313 is constituted with porous fibers, sponges or fabric materials, for example.

Next, steps for forming protective layers on the external protective layer forming apparatus structured as stated above will be explained as follows, referring to FIGS. 24–28.

Figure 24:
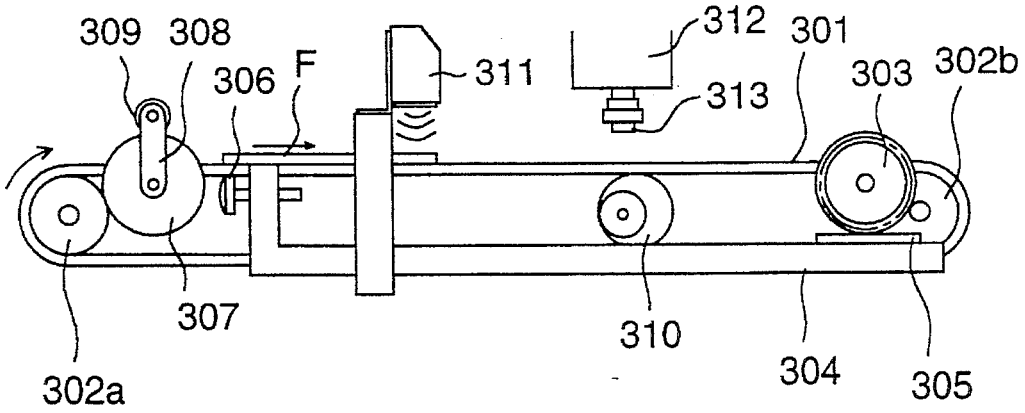

First, as shown in FIG. 24, when a position of card-shaped object F conveyed by endless belt 301 is detected by sensor 311, a first timer switch is turned on.

Figure 25:
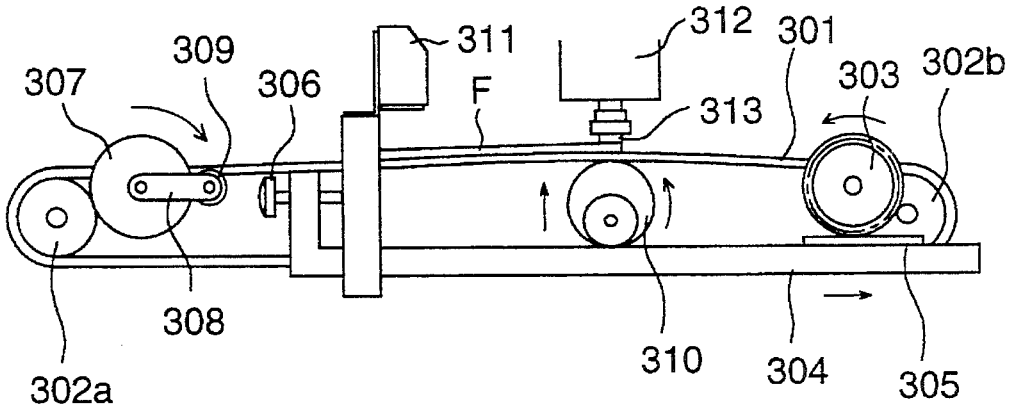

Then, a first rotary solenoid is operated by a command of the first timer switch to rotate rotating member 303, and shaft 304 is slide in the right direction as shown in FIG. 25. Then, eccentric roller 310 is rotated through interlocking with the slide of the shaft 304, thereby the card-shaped object F conveyed by the endless belt 301 is lifted toward the side of coating head 313, together with the endless belt 301.

Due to the lifting action mentioned above, a leading edge of the card-shaped object F comes in contact with the coating head 313, and coating of UV resins is started. Since the coating head 313 is composed of a highly elastic material, it is in pressure contact with the card-shaped object F and is transformed. Incidentally, an amount of a nip width in this case, namely an amount of transformation of the coating head 313 is established to be 40%–80% of a thickness of the card-shaped object.

Figure 26:
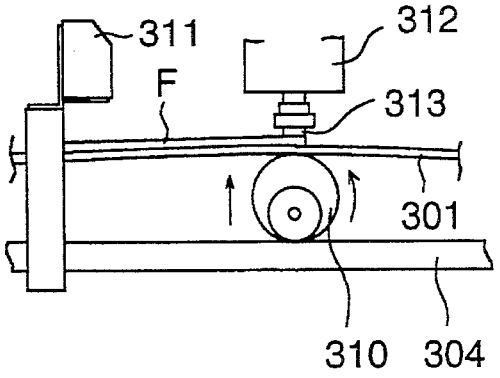

The endless belt 301 lifted by the eccentric roller 310 is shaped to be almost conical with a point of contact with the eccentric roller 310 being a vertex of the conical shape. Since the card-shaped object F is conveyed along the endless belt 301 in a conical shape, when the card-shaped object F comes in contact with the coating head 313, a leading edge of the card-shaped object F has arrived at the vertex of the endless belt, and immediately after UV resins have been coated, the card-shaped object F is in a position beyond the vertex of the endless belt 301 as shown in FIG. 26 to leave the endless belt 301. Therefore, UV resins coated on the card-shaped object F hardly stick to the endless belt 301, and in particular, spreading-to-back phenomenon that UV resins stick to the back side of the card-shaped object F at its leading edge portion does not take place and excellent products are obtained.

In the course of an operation of coating UV resins on card-shaped object F, a second rotary solenoid is rotated in the direction shown in FIG. 25 by a command from a first timer switch. Then, a second timer switch is turned on, and electrical supply to the first rotary solenoid is stopped by a command from the second timer switch just prior to completion of coating of UV resins, so that the first rotary solenoid is caused to be free. Then, eccentric roller 310 is rotated reversely in the direction opposite to that in the case of an operation of the first rotary solenoid, namely, in the clockwise direction in FIG. 27, by rotation of the endless belt 301 in the direction to the left and tension thereof, thus, the lifted endless belt 301 is lowered and an amount of a nip width of the coating head 313 is reduced.

Figure 27:
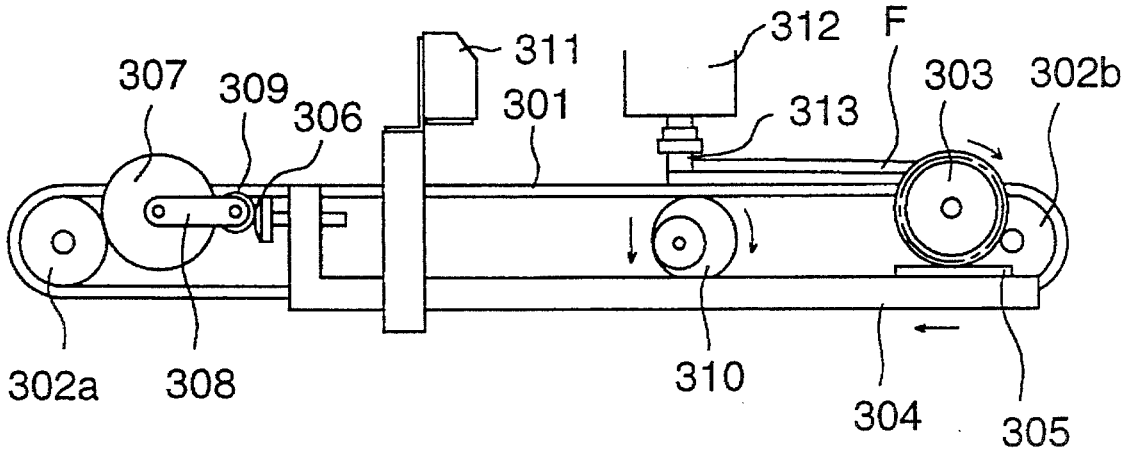

However, the eccentric roller 310 does not return fully to the initial position but stops at a predetermined position. Therefore, an amount of a nip width necessary at the moment of completion of coating of UV resins on the card-shaped object F can be secured. Securing of the amount of a nip width is carried out when roller 309 rotated by second solenoid 307 and adjuster 308 come in contact with each other before the eccentric roller 310 returns fully so that they may regulate the retreated position of shaft 304 as shown in FIG. 27.

Since an amount of a nip width is reduced just prior to completion of coating of UV resins as stated above, even when an amount of a nip width is reduced to zero when a trailing edge of the card-shaped object F has passed the coating head 313, the endless belt 301 and the coating head 313 do not come in contact with each other, thereby the endless belt 301 is not stained with UV resins.

Figure 28:
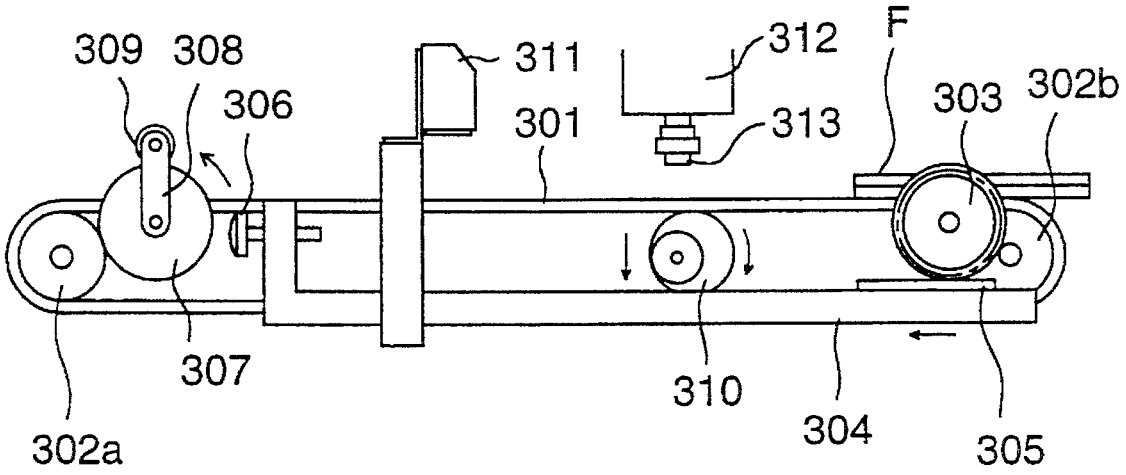

After completion of coating of UV resins, a third timer switch is turned on and the second rotary solenoid 307 is operated to cause roller 309 to return to its initial position so that the regulation of the retreated position of the shaft 304 may be released as shown in FIG. 28. Owing to this, the eccentric roller 310 is returned fully to its initial position by residual tension of the endless belt 301 and the shaft 304 is also returned fully to its initial position, being interlocked with the foregoing.

After this, the card-shaped object F is conveyed to a processing unit for hardening where a protective layer of UV resins is hardened to be a product.

Incidentally, when a protective layer was formed on a card under the following conditions, on the apparatus mentioned above, a protective layer having a uniform aimed thickness was formed on the surface of the card and there happened no problem that UV resins spread to the back side of the card. Further, there happened neither the problem that UV resins stuck to the endless belt, nor the problem that the apparatus was stained.

Conditions

Coating solution: UV-setting resins of an epoxy type,

Object to be coated: PET card (thickness of 500 μm)

Target layer thickness: 10 μm

FIG. 29 is a schematic side view of the second example of an external protective layer forming apparatus related to the invention.

In FIG. 29, the numeral 314 is an endless belt for conveying card-shaped object F which is stretched around rollers 315*a* and 315*b* arranged in front and in rear of the apparatus so that it is rotated in the direction of advancement of the work.

The numeral 316 is a linear-motion solenoid which is operated by signals from a plurality of timer switches (not shown). Incidentally, in place of the linear-motion solenoid, an appropriate rotation/linear-motion converting mechanism such as a stepping motor or a rotary solenoid may be used.

The numeral 317 is a lever unit whose one end is provided with an elongated hole, and the linear-motion solenoid 316 is coupled with the lever unit 317 in a manner that an upper end of a reciprocating shaft of the linear-motion solenoid 316 may move loosely along the aforementioned elongated hole.

The numeral 318 is a coupling member, 319 is a tank for containing UV resins coupled with the lever unit 317 through the coupling member 318, and the tank 319 is supported by guide 320 so that it may rise and fall perpendicularly to the endless belt 314.

Namely, when the reciprocating shaft of the linear-motion solenoid 316 is pushed out upward, the lever unit 317 is rotated counterclockwise with fulcrum 317a to push the tank 319 down, and when the reciprocating shaft 316 is pulled back downward, on the contrary, the tank 319 is pulled upward.

The numeral 321 is a coating head provided under the tank 319, the numeral 322 is a sensor for detecting the position of card-shaped object F conveyed by the endless belt 314, and the sensor is coupled with the timer switch to control the linear-motion solenoid 316.

In the external protective layer forming apparatus as that in the foregoing, a space between the card-shaped object F and the coating head 321 is adjusted by moving the coating head 321 up and down to coat UV resins on the card-shaped object F. Namely, when the position of card-shaped object F conveyed by the endless belt 314 is detected by the sensor 322, the first timer switch is turned on, first. Then, when the card-shaped object F is conveyed to a predetermined position by the endless belt 314, the reciprocating shaft of the linear-motion solenoid 316 is pushed out by a command from the first timer switch to push the tank 319 down so that the coating head 321 may come in contact with the card-shaped object F with a predetermined amount of a nip width. Thus, coating of UV resins on the card-shaped object F is started.

After that, the second timer switch is turned on, then, the reciprocating shaft of the linear-motion solenoid 316 is pulled back by a command from the second timer switch just prior to completion of coating of UV resins, and the tank 319 is slightly lifted to reduce an amount of a nip width of the coating head 321. Incidentally, since a distance between a fulcrum and a force-applying point of lever portion 317 is longer than that between a fulcrum and a point of action thereof, a distance of a vertical movement of tank 319 is small compared with that of a movement of the reciprocating shaft of the linear-motion solenoid 316 due to the theory of levers. Therefore, positioning accuracy is excellent and driving torque can be small.

Since an amount of a nip width is reduced just prior to completion of coating UV resins in the manner mentioned above, endless belt 314 and coating head 321 do not come in contact with each other when card-shaped object F passes the coating head 321, thus, the endless belt 314 is neither stained nor damaged.

Then, the third timer switch is turned on, and the reciprocating shaft of the linear-motion solenoid 316 is pulled back fully by a command from the third timer switch at the moment of completion of coating, thereby tank 319 is returned fully to its initial position and an operation of coating UV resins is completed.

When a protective layer was formed on a card in the same manner as in the first example under the following conditions by the use of the apparatus mentioned above, the protective layer formed on the surface of the card showed a uniform and aimed thickness, and light-transmitting hardening agents did not flow over the edge of the card to leak to the reverse side thereof. In addition, the light-transmitting hardening agents did not stick to the endless belt, and the apparatus was neither stained nor damaged.

| (Conditions) | |
|---|---|
| Coating solution | Epoxy type UV-setting resin |
| Object to be coated: | PET card (thickness of 500 μm) |
| Target layer thickness: | 10 μm |

Incidentally, each of FIGS. 30–36 shows how card-shaped object F and a coating head are brought into-contact with each other when a resin solution is coated. In the figure, a locus shown with an arrow represents a relative position between a point where the coating head is located and the card-shaped object F.

Figure 30:
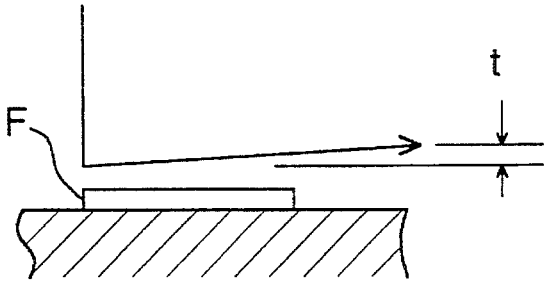

FIG. 30 shows how card-shaped object F and a coating head are in contact with each other wherein the coating head comes in contact with the card-shaped object F first, and when they move relatively while they are in contact with each other, an amount of transformation of the coating head is reduced linearly. The rate of reduction in an amount of a nip width of the coating head, namely, an inclination of a locus of the coating head represented by "t" is normally about 20–40% of the card thickness, though it depends on the card-shaped object size.

Figure 31:
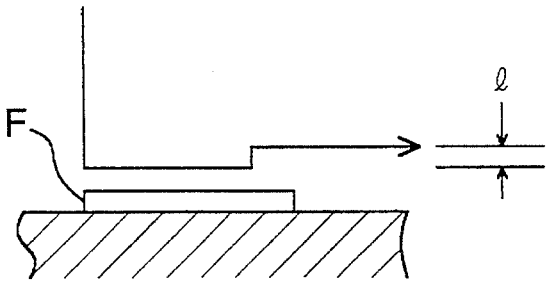
Figure 32:
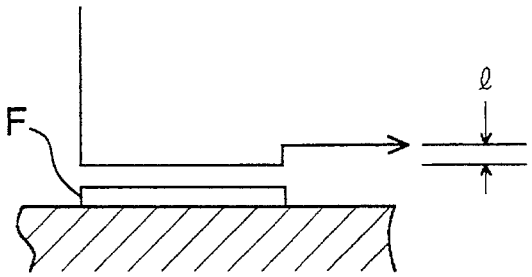
Figure 33:
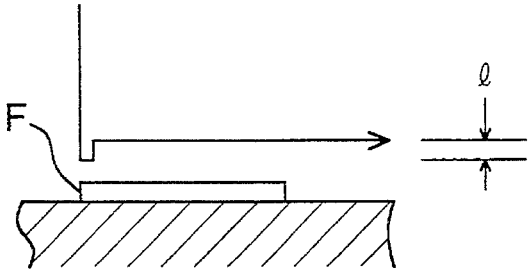

Each of FIGS. 31–33 shows how card-shaped object F and a coating head are in contact with each other wherein the coating head comes in contact with the card-shaped object F first, and they move relatively while they are in contact with each other, an amount of transformation of the coating head is reduced stepwise. In any of the cases of FIGS. 26–28, a distance "l" by which the coating head is lifted for the reduction of an amount of a nip width is normally 20–40% of the card-shaped object thickness.

Figure 34:
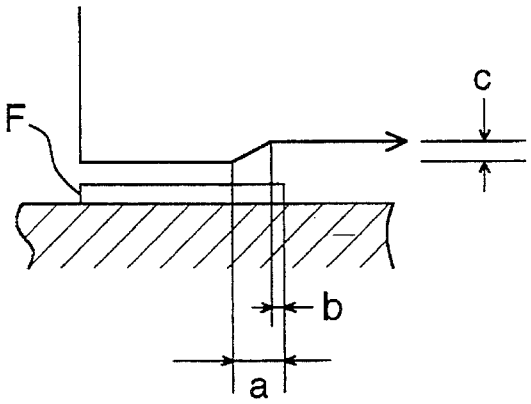
Figure 35:
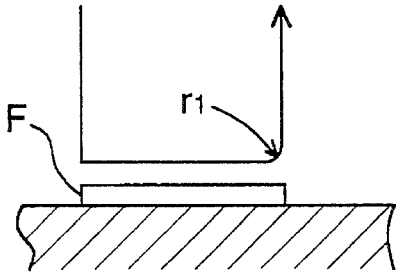
Figure 36:
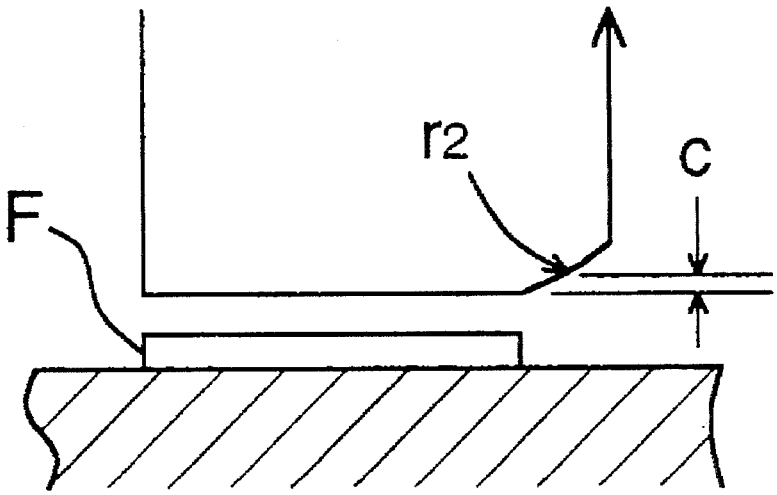

Each of FIGS. 34–36 shows how card-shaped object F and a coating head are in contact with other wherein an amount of transformation of the coating head is kept constant in the initial stage of contact between the coating head and the card-shaped object F, and then the amount of transformation of the coating head is reduced. In FIG. 34, when an end of the coating head positioned at the leading edge side of the card-shaped object F comes to the point that is away from the trailing edge of the card-shaped object F by distance "a" (a length of the coating head in the direction of the card-shaped object transportation), the coating head is lifted gradually by distance "c" (20–40% of the card-shaped object thickness) to reduce the amount of a nip width at a constant rate, and when the end of the coating head comes to the point being away from the trailing edge of the card-shaped object F by distance "b" (about a half of "a"), lifting of the coating head is stopped so that the amount of a nip width may be kept constant until completion of coating.

In FIG. 35, the coating head is lifted in a manner that a locus of its movement shows a curved line so that an amount of a nip width may be reduced sharply, and radius of curvature $r_1$ is normally 0.1–0.5 mm.

FIG. 36, on the other hand, shows a combination of those shown in previous FIGS. 34 and 35. Normally, distance "c" for lifting the coating head is 20–40% of the card-shaped object thickness and radius of curvature $r_2$ is 1–20 mm, which are determined appropriately depending upon where the lifting of the coating head is started.

In the invention, when coating resin solution on the surface of a card-shaped object, the card-shaped object and an apparatus are hardly stained, and the resin solution can be coated uniformly on the surface of the card-shaped object, making it possible to obtain excellent products.

What is claimed is:

1. An apparatus for forming a protective layer on a card by use of a resin solution, comprising;

coating means for coating the resin solution on the card, the coating means including a coating head which has a fiber member to which the resin solution is fed, and the coating means being relatively positioned on the card so as to be brought in contact with a portion of a surface of the card so that the resin solution is transferred onto the contact portion of the card through the fiber member;

moving means coupled to the coating means for selectively moving at least one of the coating head and the card so as to move the contact portion along the surface of the card so that the surface of the card is coated with the resin solution; and wherein the fiber-member comprises a velvet material that is formed into a web-shaped member which extends between a supply reel and a take-up reel; and the web-shaped member is arranged to be associated with a periphery of the coating head between the supply reel and the take-up reel so that the web-shaped member is sequentially used at the periphery of the coating head.

2. An apparatus for forming a protective layer on a card by use of a resin solution, comprising;

coating means for coating the resin solution on the card, the coating means including a coating head which has a fiber member to which the resin solution is fed, and the coating means being relatively positioned on the card so as to be brought in contact with a portion of a surface of the card so that the resin solution is transferred onto the contact portion of the card through the fiber member;

moving means coupled to the coating means for selectively moving at least one of the coating head and the card so as to move the contact portion along the surface of the card so that the surface of the card is coated with the resin solution;

wherein the fiber member comprises a velvet material that is formed into a web-shaped member; and wherein the web-shaped member comprises an endless belt extended between a reel and the periphery of the coating head so that the endless belt is sequentially used at the periphery of the coating head.

3. An apparatus for forming a protective layer on a card by use of a resin solution, comprising;

coating means for coating the resin solution on the card, the coating means including a coating head which has a fiber member to which the resin solution is fed, and the coating means being relatively positioned on the card so as to be brought in contact with a portion of a surface of the card so that the resin solution is transferred onto the contact portion of the card through the fiber member;

moving means coupled to the coating means for selectively moving at least one of the coating head and the card so as to move the contact portion along the surface of the card so that the surface of the card is coated with the resin solution;

wherein the coating head comprises a regulator that is responsive to a contact between the coating head and the card for regulating an amount of the coating solution which is fed to the fiber member during a coating period; and wherein the regulator includes a rod and a valve; and the rod is responsive to said contact and actuates the valve so as to regulate the amount of the fed coating solution.

4. An apparatus for forming a protective layer on a card by use of a resin solution, comprising;

coating means for coating the resin solution on the card, the coating means including a coating head which has a fiber member to which the resin solution is fed, and the coating means being relatively positioned on the card so as to be brought in contact with a portion of a surface of the card so that the resin solution is transferred onto the contact portion of the card through the fiber member;

moving means coupled to the coating means for selectively moving at least one of the coating head and the card so as to move the contact portion along the surface of the card so that the surface of the card is coated with the resin solution; and wherein the coating means further comprises:

an external solution tank provided independently of the coating head and the coating solution is fed from the external solution tank to the coating head by gravity; and further comprising a coating solution container having an open top and which is placed upside down in the external solution tank so as to pour the coating solution downwardly through the open top; and wherein the open top is sealed with the coating solution in the external solution tank so that the coating solution in the container is supplied into the external solution tank when a level of the coating solution in the external solution tank is lower than a predetermined level and the level of the coating solution is kept around the predetermined level.

5. An apparatus for forming a protective layer on a card by use of a resin solution, comprising;

coating means for coating the resin solution on the card, the coating means including a coating head which has a fiber member to which the resin solution is fed, and the coating means being relatively positioned on the card so as to be brought in contact with a portion of a surface of the card so that the resin solution is transferred onto the contact portion of the card through the fiber member;

moving means coupled to the coating means for selectively moving at least one of the coating head and the card so as to move the contact portion along the surface of the card so that the surface of the card is coated with the resin solution; and wherein the coating means comprises lifting means for selectively lifting at least one of the coating head and the card so as to bring the card in contact with the coating head or to remove the card from the coating head; and the moving means comprises a belt conveyor on which the card is loaded; and the lifting means lifts up the belt conveyor so as to bring the card in contact with the coating head during a coating period and lowers the belt conveyor during a non-coating period.

6. An apparatus for forming a protective layer on a card by use of a resin solution, comprising;

coating means for coating the resin solution on the card, the coating means including a coating head which has a fiber member to which the resin solution is fed, and the coating means being relatively positioned on the card so as to be brought in contact with a portion of a surface of the card so that the resin solution is transferred onto the contact portion of the card through the fiber member;

moving means coupled to the coating means for selectively moving at least one of the coating head and the card so as to move the contact portion along the surface of the card so that the surface of the card is coated with the resin solution; and wherein the coating means comprises:

an external solution tank provided independently of the coating head and the coating solution is fed from the external solution tank to the coating head by gravity;

a solution container having an open top that is placed upside down in the external solution tank so as to pour down the coating solution through the open top, and wherein the open top is sealed with the coating solution in the external solution tank so that the coating solution in the container is supplied into the external tank when the level of the coating solution in the tank is lower than a predetermined level and the level of the coating solution is kept around the predetermined level; and wherein said container comprises an open top bottle.

7. An apparatus for forming a protective layer on a card by use of a resin solution, comprising;

coating means for coating the resin solution on the card, the coating means including a coating head which has a fiber member to which the resin solution is fed, and the coating means being relatively positioned on the card so as to be brought in contact with a portion of a surface of the card so that the resin solution is transferred onto the contact portion of the card through the fiber member;

moving means coupled to the coating means for selectively moving at least one of the coating head and the card so as to move the contact portion along the surface of the card so that the surface of the card is coated with the resin solution;

the coating means comprises:

an external solution tank provided independently of the coating head; and wherein the coating solution is fed from the external solution tank to the coating head by gravity; and further comprising a solenoid valve provided between the external solution tank and the coating head, the solenoid valve regulating a feeding amount of the coating solution; and wherein the solenoid valve regulates the feeding amount of the coating solution in accordance with a level of the coating solution in the external solution tank.

8. An apparatus for forming a protective layer on a card by use of a resin solution, comprising;

a moving device to move the card along a predetermined conveyance passage;

a coater to coat a resin solution on a surface of the card, the coater being located in a vicinity of the conveyance passage, the coater including:

a coating head which has a fiber member to which the resin solution is fed;

the coating head being arranged to assume a position on the card in the conveyance passage so that the coater head and a contact portion of a surface of the card are brought in contact with each other;

the resin solution being transferred onto the contact portion of the card through the fiber member; and the surface of the card being coated with the resin solution by the coating head while the card is being moved along the conveyance passage;

a hardening device to irradiate hardening rays onto the surface of the card, the hardening device being located in a vicinity of the conveyance passage so that the card is further moved from the coater to the hardening device by the moving device after the surface of the card has been coated with resin solution and the resin solution is hardened with the hardening rays so as to form the protective layer on the coated surface of the card; and the coater, the hardening device and the conveyance passage of the moving device all being arranged in such a manner that a location level of the hardening device is different from another location level of the coater so that the coater is sheltered from the hardening rays.

9. The apparatus of claim 8, wherein the coating head comprises an internal solution tank in which is provided an internal member through which the coating solution is fed to the fiber member.

10. The apparatus of claim 8, wherein the coating head comprises an internal solution tank in which is provided a groove to distribute the coating solution.

11. The apparatus of claim 8, wherein the coating head comprises a regulator responsive to contact between the coating head and the card for regulating an amount of the coating solution which is fed to the fiber member during a coating period.

12. The apparatus of claim 8, wherein:

the coater comprises an external solution tank provided independently of the coating head; and the coating solution is fed from the external solution tank to the coating head by gravity.

13. The apparatus of claim 12, further comprising a solenoid valve provided between the external solution tank and the coating head, the solenoid valve regulating the feeding amount of the coating solution.

14. The apparatus of claim 12, further comprising a temperature controller positioned to sense a temperature of the coating solution in the external solution tank and for controlling a temperature of the coating solution in the external solution tank so as to keep a predetermined viscosity of the coating solution.

15. The apparatus of claim 8, wherein the location level of the hardening device is lower than the another location level of the coater.

16. The apparatus of claim 15, wherein the conveyance passage in a vicinity of the hardening device is slanted relative to a horizontal plan so as to be lower than a location level of the conveyance passage in a vicinity of the coater.

17. The apparatus of claim 15, wherein the hardening device is arranged to be positioned on the card in the conveyance passage so that a gap having a dimensional (a) is formed between the hardening device and the conveyance passage, and wherein the hardening rays are irradiated onto the card through the gap.

18. The apparatus of claim 17, wherein a level difference (L) between the conveyance passage at a vicinity of the coater and the conveyance passage at a vicinity of the hardening device is larger than the gap dimension (a).

19. The apparatus of claim 8, wherein a hardening ray shielding plate is provided between the coater and the hardening device.

20. The apparatus of claim 8, wherein the moving device comprises a belt conveyor.

21. The apparatus of claim 8, wherein the coater includes a lifting device to selectively lift at least one of the coating head and the card so as to one of bring the card into contact with the coating head and to remove the card from contact with the coating head.

22. The apparatus of claim 21, wherein:

a contacting portion of the coating head is flexible so that a coating portion of the coating head is deformed in accordance with an extent of a pressure contact created by the lifting device; and the lifting device regulates the pressure contact so that an amount of the deformation of the coating portion of the coating head is relatively large at a time of starting a coating and is reduced as a coating point is advancing.

23. The apparatus of claim 22, wherein the lifting device regulates the pressure contact so that the amount of the deformation of the coating portion of the coating head is relatively large at the time of starting the coating and is reduced as the coating point is advancing.

24. The apparatus of claim 22, wherein the lifting device maintains a relatively large amount of the deformation during a coating initial stage, and thereafter the lifting device reduces the amount of deformation of the coating portion of the coating head.

25. The apparatus of claim 8, wherein the fiber member comprises a velvet material that is formed into a web-shaped member.

26. The apparatus of claim 25, wherein the fiber member comprises a sheet-shaped member associated with a periphery of the coater such that the sheet-shaped member is replaceable with a new sheet shaped member from outside of the coater.

* * * * *